US006578941B2

(12) United States Patent
Arai et al.

(10) Patent No.: US 6,578,941 B2
(45) Date of Patent: Jun. 17, 2003

(54) INK JET PRINTER

(75) Inventors: Kenichiro Arai, Nagano (JP); Yukihiro Hanaoka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/098,176

(22) Filed: Mar. 15, 2002

(65) Prior Publication Data

US 2002/0140759 A1 Oct. 3, 2002

(30) Foreign Application Priority Data

Mar. 15, 2001 (JP) ..... 2001-074437

(51) Int. Cl.[7] ..... B41J 2/175
(52) U.S. Cl. ..... 347/7; 347/19; 347/37
(58) Field of Search ..... 347/7, 19, 37, 347/85–87

(56) References Cited

U.S. PATENT DOCUMENTS

| | | | | |
|---|---|---|---|---|
| 4,709,248 A | | 11/1987 | Piatt et al. | |
| 5,721,581 A | | 2/1998 | Saito et al. | |
| 5,997,121 A | * | 12/1999 | Altfather et al. | 347/7 |
| 6,155,664 A | * | 12/2000 | Cook | 347/7 |
| 6,443,546 B1 | * | 9/2002 | Takagi | 347/7 |

FOREIGN PATENT DOCUMENTS

| | | |
|---|---|---|
| EP | 0 361 753 | 4/1990 |
| EP | 0 540 244 | 5/1993 |
| EP | 0626 267 | 11/1994 |
| EP | 0 689 936 | 1/1996 |
| EP | 0 718 104 | 6/1996 |

OTHER PUBLICATIONS

Patent Abstract of Japan, vol. 016, No. 495 (P–1436), Oct. 14, 1992 and JP 04 178638 A (Canon Inc.).

* cited by examiner

*Primary Examiner*—Craig Hallacher
(74) *Attorney, Agent, or Firm*—Nixon & Vanderhye P.C.

(57) ABSTRACT

An ink jet printer including an optical detector attached to a carriage on which a head chip is mounted, and one or more detected parts that can be detected by the detector formed on sides of ink cartridges placed in an ink cartridge holder. Each of the detected parts may be implemented as a right-angle prism. The one or more detected parts are operable to detect the presence or absence of ink and the corresponding ink cartridge being placed, among other features. Since the common optical detector and the one or more detected parts can detect a plurality of pieces of information, the ink jet printer is extremely advantageous for cost reduction and miniaturization as compared with the case where dedicated detection mechanisms are provided in a one-to-one correspondence with pieces of information to be detected as in a related art.

26 Claims, 21 Drawing Sheets

INK JET PRINTER

BACKGROUND OF INVENTION

1. Field of the Invention

This invention relates to a serial ink jet printer for supplying ink from an ink supply section at a fixed position to an ink jet head mounted on a carriage, moving the carriage in a print width direction, and printing on a recording medium passing through a print position. More particularly, the invention relates to a serial ink jet printer that includes a detection mechanism for detecting, among other things, the presence or absence of ink in an ink supply section and the move position of a carriage in the serial ink jet printer.

2. Related Art

Known as an ink jet printer is a serial ink jet printer for reciprocating a carriage on which an ink jet head is mounted in the print width direction of a transported recording paper and printing on a predetermined surface of the recording paper. As the serial ink jet printer, an off-carriage type serial ink jet printer is available, wherein an ink supply section such as an ink cartridge is not mounted on a carriage, but rather is placed at a fixed position and ink is supplied from the ink supply section via a flexible ink tube to an ink jet head mounted on the carriage.

In the off-carriage type serial ink jet printer, a plurality of ink tanks storing different color inks, for example, a plurality of ink cartridges, are placed in the ink supply section to perform multicolor print. In this case, it is necessary to detect the ink cartridges being placed in the ink supply section and the presence or absence of ink in each ink cartridge. To do this, in the related art, a dedicated detection mechanism for detecting each ink cartridge being placed and a dedicated detection mechanism for detecting the presence or absence of ink are used. Generally, each detection mechanism is made up of an optical detector, etc., and a detected part detected by the detector.

Further, in the serial ink jet printer of the related art, to control the move position of the carriage, a detection mechanism for detecting the home position of the carriage as the reference for controlling the move position of the carriage is used.

Therefore, for example, if the serial ink jet printer comprises the ink supply section in which two ink cartridges are placed, two detection mechanisms for detecting the presence or absence of the ink cartridges, two detection mechanisms for detecting the presence or absence of ink in the ink cartridges, and one detection mechanism for detecting the carriage home position (five detection mechanisms in total) are required.

Also known in the related art is a serial ink jet printer wherein an ink supply section can be switched between a single-color cartridge and a multicolor cartridge for use, and both single-color print and multicolor print can be performed. In this serial ink jet printer, single-color print or multicolor print is specified by operating a DIP switch, etc., installed on a printer controller.

However, to detect the presence or absence of each ink cartridge, the presence or absence of ink in the cartridges, and the carriage home position by separate detection mechanisms as in the related art, the number of the detection mechanisms increases, which in turn increases the costs and inhibits miniaturization of this type of ink jet printer.

With the serial ink jet printer wherein single-color print or multicolor print is specified by operating a DIP switch, etc., when the user forgets to switch the DIP switch, etc., a single-color print may be executed although the user intends to execute multicolor print and vice versa, for example.

SUMMARY OF THE INVENTION

It is therefore an object of the invention to make it possible to determine information concerning an ink supply section such as the presence or absence of ink, information concerning the move position of the carriage such as a home position of a carriage, and whether the print mode is single-color print or multicolor print by a fewer number of detection mechanisms in an off-carriage type serial ink jet printer.

To this end, according to the invention, there is provided an ink jet printer comprising an ink jet head, a carriage for moving the ink jet head in a print width direction, an ink supply section placed at a fixed position for supplying ink to the ink jet head, and a detector and one or more detected parts that can be detected by the detector, wherein the one or more detected parts are placed at a position along a move passage of the detector, and the one or more detected parts are operable to indicate at least one of information concerning the ink supply section and information concerning the move position of the carriage.

In the invention, the detector is mounted on the carriage and is moved together with the carriage for detecting the one or more detected parts. Therefore, if a plurality of detected parts are placed, the detector for detecting the detected parts can be made common. Thus, the invention is advantageous for cost reduction and miniaturization as compared with the detection system comprising detectors and detected parts provided in a one-to-one correspondence with the objects to be detected as in the related art.

In the invention, the information concerning the ink supply section may be, for example, at least one of information indicating whether or not ink exists in the ink supply section and information representing the type of ink stored in the ink supply section.

In addition, the information concerning the move position of the carriage may include information indicating whether or not the carriage is at the home position, etc.

Generally, as the one or more detected parts, a first detected part that can indicate the information concerning the ink supply section and a second detected part that can indicate the information concerning the move position of the carriage may be used.

The detector can be an optical detector comprising a light emission element and a light reception element. In this case, the one or more detected parts can each include a prism having one or more reflection faces for reflecting light from the light emission element toward the light reception element.

If the one or more detected parts indicate the information concerning the ink supply section, the corresponding prism may be formed in a side wall portion of an ink reservoir of the ink supply section. In doing so, if ink exists in the ink reservoir, the back of the one or more reflection faces of the corresponding prism are immersed in the ink and thus the one or more reflection faces do not function as a reflection face and therefore the detector does not detect reflected light. In contrast, if the ink reservoir becomes empty of ink, the one or more reflection faces of the corresponding prism are exposed from the ink and function as reflection faces and therefore the detector detects reflected light. Thus, the presence or absence of ink can be detected based on the presence or absence of reflected light.

To determine the type of ink stored in the ink supply section, the one or more reflection faces need to be made effective regardless of the presence or absence of ink. To do this, one or more of the detected parts may comprise a gap formed between the one or more reflection faces of a corresponding prism and the side wall portion opposed thereto on an opposite side to the light incidence direction from the detector on the corresponding prism. The one or more reflection faces are made effective regardless of the presence or absence of ink in the presence of the gap.

Next, the ink supply section may be a cartridge type having an ink cartridge placement section and an ink cartridge detachably placed therein.

In this embodiment, like above, if the one or more detected parts can indicate the information concerning the ink supply section, the information concerning the ink supply section can be at least one of information indicating whether or not the ink cartridge is placed in the ink cartridge placement section, information concerning the type of placed ink cartridge, and information indicating whether or not ink exists in the placed ink cartridge.

Also in this case, the detector can be an optical detector comprising a light emission element and a light reception element and the one or more detected parts can each include a prism having one or more reflection faces for reflecting light from the light emission element toward the light reception element.

Further, the one or more detected parts can indicate the information concerning the ink supply section and the prism of each of the one or more detected parts may be formed in a side wall portion of an ink reservoir of the ink cartridge.

Here, one or more of the detected parts can include a gap formed between the one or more reflection faces of its corresponding prism and the side wall portion opposed thereto on an opposite side to the light incidence direction from the detector on the corresponding prism.

Also, the one or more detected parts can be embodied as first and second detected parts. In this case, the first and second detected parts may be placed at different positions along the move passage of the detector in the side wall portion of the ink cartridge placed in the ink cartridge placement section.

Further, the second detected part can include a gap formed between the one or more reflection faces of its corresponding prism and the side plate portion opposed thereto on an opposite side to the light incidence direction from the detector on the corresponding prism.

In doing so, the first detected part can detect the presence or absence of ink in the ink cartridge. Moreover, the second detected part can detect the ink cartridge being placed in the ink cartridge placement section or can detect the type of ink cartridge.

To make it possible to detect the type of ink cartridge, the formation position of the second detected part may be a different position along the move passage of the detector in response to the type of ink cartridge.

Here, if a plurality of ink cartridges, for example, first and second ink cartridges are placed in the ink cartridge placement section, each of the first and second ink cartridges may be formed with the first and second detected parts.

In this case, for example, if a third ink cartridge placed singly in the ink cartridge placement section for use to perform single-color print is included, the third ink cartridge may also be formed with the first and second detected parts, and in a placement state in the ink cartridge placement section, the positions of the second detected parts of the first and second ink cartridges may be made to differ from the position of the second detected part of the third ink cartridge.

In doing so, the type of ink cartridge can be determined based on output of the detector mounted on the carriage and the detection position of reflected light, and whether the print mode is single-color print or multicolor print can be determined based on this determination.

Of course, in the invention, the detector mounted on the carriage may also be a plurality of detectors.

Further, according to the present invention, there is provided an ink jet printer comprising an ink jet head, a carriage mounting the ink jet head and moveable in a print width direction, an ink cartridge accommodating an ink supplied to the ink jet and attached to a ink cartridge holder, an optical detector including a light emission element and a light reception element, and mounted to one of the carriage and a mounting member fixed on a predetermined position, a detected member that can be detected by the optical detector, and the detected member is operable to change its position in accordance with an attached or removed condition of the ink cartridge with respect to the ink cartridge holder.

In the construction described above, the detected member is embodied as a movable type such that the position of the detected member is operable to change in accordance with the attached or removed condition of the ink cartridge. Thus, the attached or removed condition of the ink cartridge can be accurately detected.

Further, it is preferable for providing the detected member with a slidable and/or rotatable feature with respect to the ink cartridge holder. In this construction, the movable detected member is simply constructed to avoid increasing the manufacturing costs associated with the ink cartridge holder.

Still further, the detected member may be urged by an urging member to a first position, and move to a second position by contacting the ink cartridge.

DETAILED DESCRIPTION OF PREFERRED EMBODIMENTS

Referring now to the accompanying drawings, there is shown an embodiment of an off-carriage type serial ink jet printer incorporating the invention.

Figure 1:
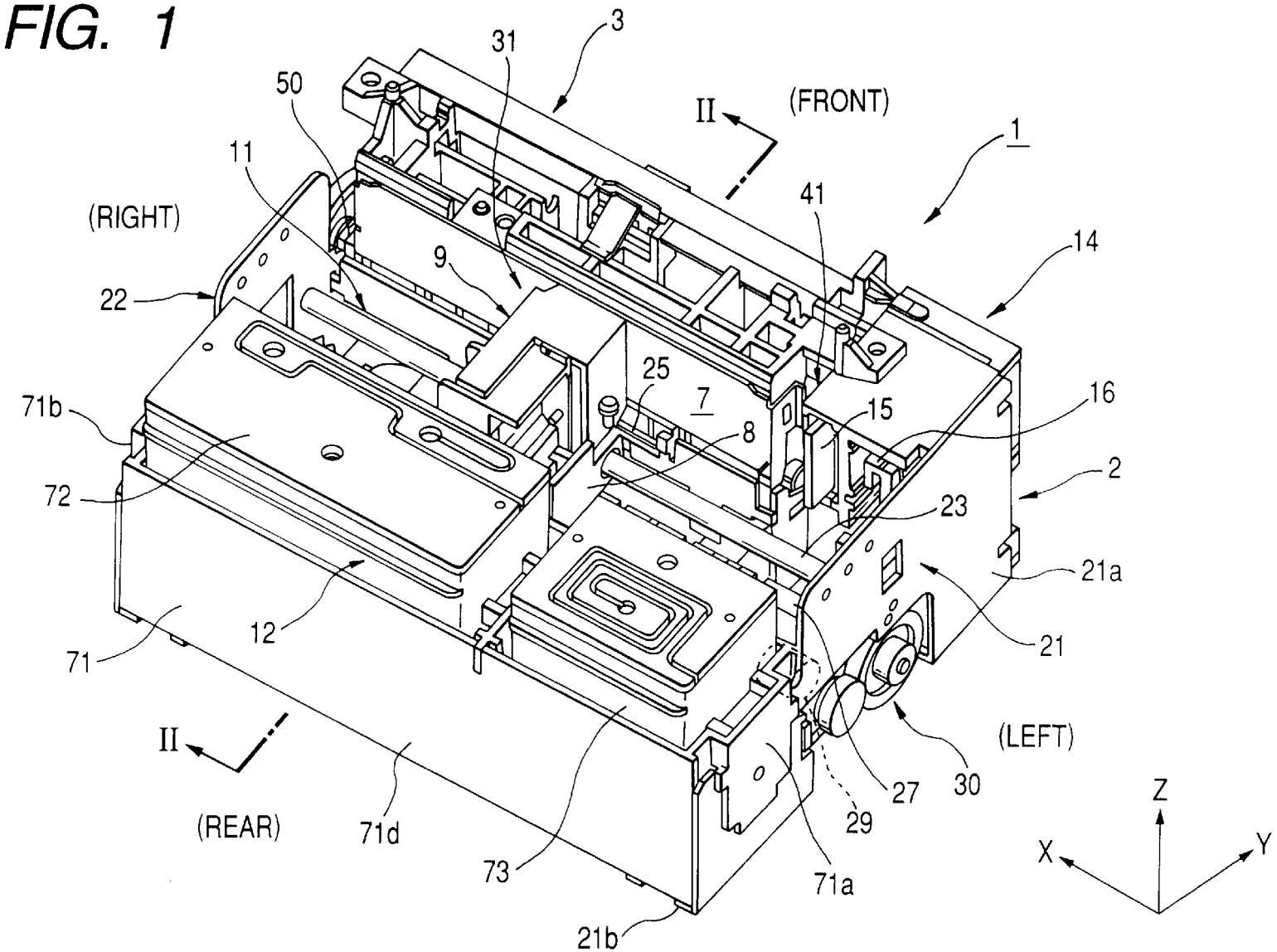
FIG. 1 is a perspective view to show the structure of an ink jet printer incorporating the invention.
Figure 2:
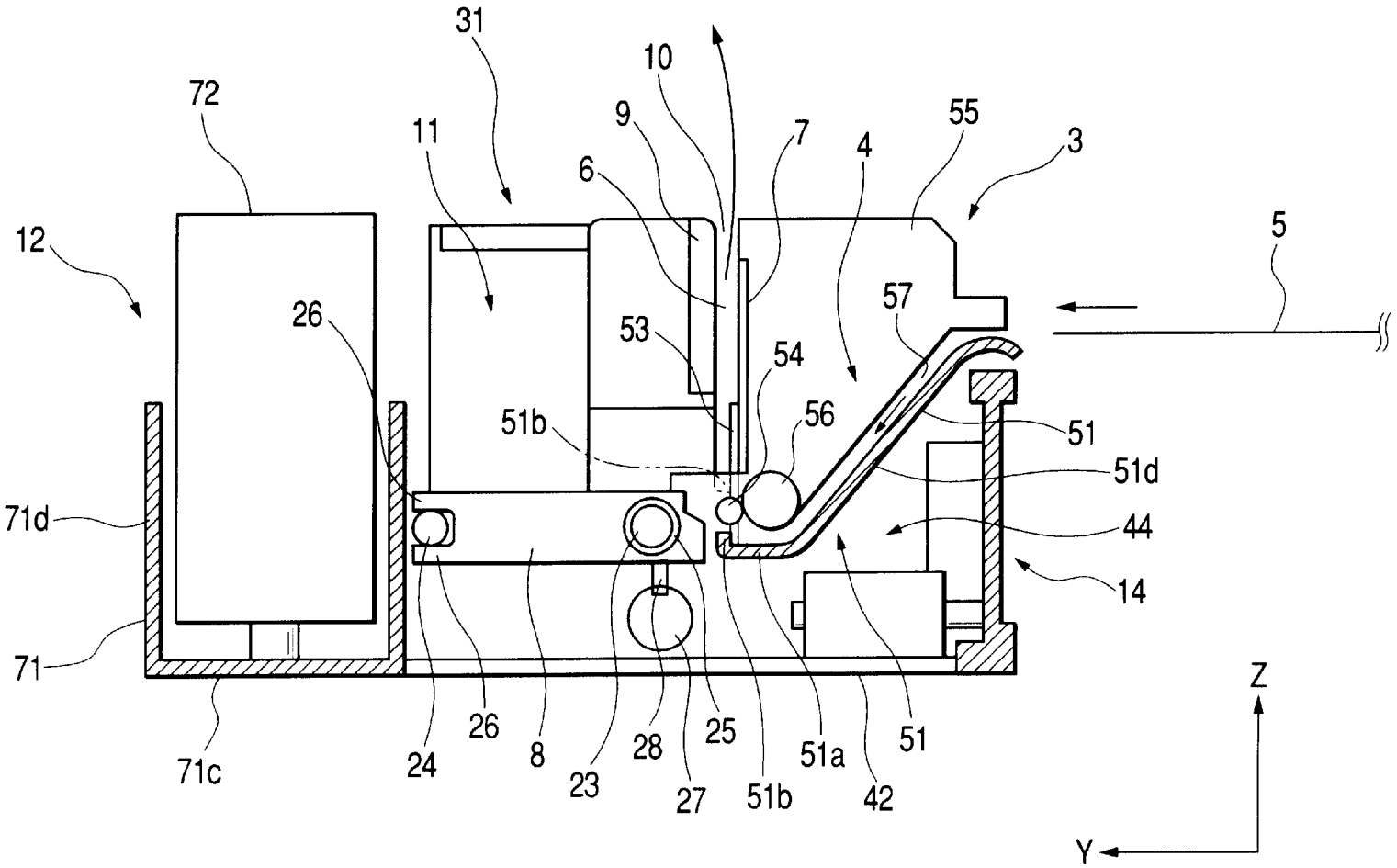
FIG. 2 is a schematically sectional view taken on line II—II in FIG. 1.
Figure 3:
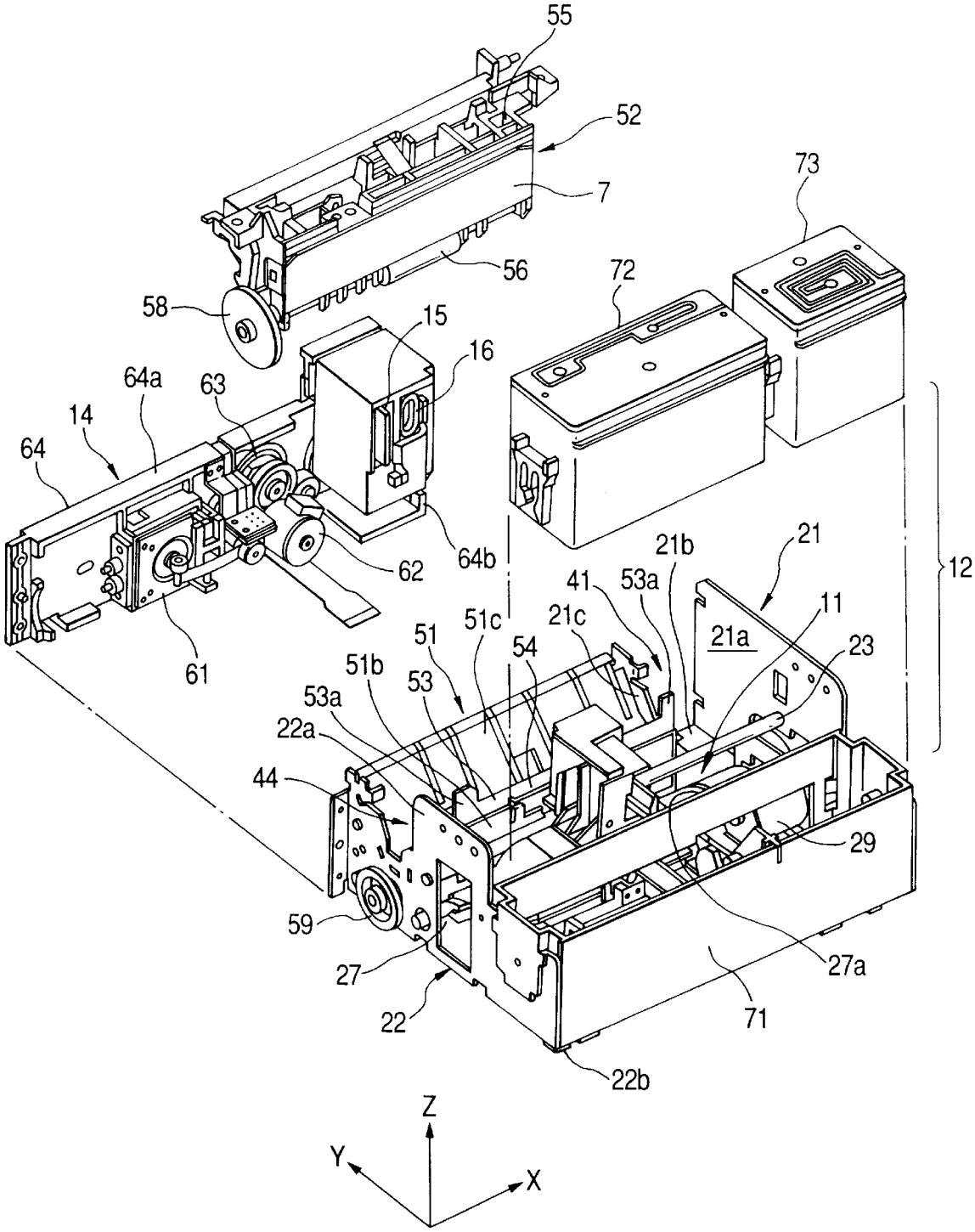
FIG. 3 is an exploded perspective view to show the ink jet printer in FIG. 1 in a state in which main parts of the ink jet printer are disassembled.

FIG. 1 is a perspective view to show the internal structure of an ink jet printer of the embodiment, FIG. 2 is a schematically sectional view taken on line II—II in FIG. 1, and FIG. 3 is an exploded perspective view to show the ink jet printer in a state in which units are disassembled. Referring to FIGS. 1 to 3, the ink jet printer 1 of the embodiment comprises parts placed in a printer frame assembly 2 shaped like a flat rectangular box as a whole and a recording paper transport section 3 placed on the front end of the printer, formed with a recording paper transport passage 4 shaped like a V letter. Recording paper 5 passes through the recording paper transport passage 4 and is ejected to the top via a print position 6.

A nozzle face 10 of a head chip 9 in which an ink jet head is built, mounted on a carriage 8 is opposed to a platen plate 7 placed in an upright position for defining the print position 6. As the carriage 8 is moved, the head chip 9 is reciprocated in a printer width direction x of a print width direction for performing predetermined print on the surface of the recording paper 5 passing through the print position 6. An ink supply section 12 for supplying ink to the head chip 9 is placed in the rear of a carriage move space 11 formed for moving the carriage 8 and extending in the printer width direction x. Ink is supplied from the ink supply section 12 via a flexible ink tube 13 (see FIG. 4) to the head chip 9 moved with the carriage 8.

A head maintenance unit 14 is placed from the back to side of the recording paper transport section 3. The head maintenance unit 14 comprises a wiper 15 and a head cap 16 opposed to the nozzle face 10 of the head chip 9 at one end of the move passage of the carriage 8. Dirt of the nozzle face 10 is wiped by the wiper 15. Ink is ejected from each ink nozzle of the head chip 9 in an opposed state to the head cap 16 or ink is ejected with the head cap 16 put on the nozzle face 10, whereby the recovery operation of each ink nozzle is performed.

Next, the placement relationship among the parts of the described ink jet printer 1 and the detailed structure thereof will be discussed.

To begin with, the printer frame assembly 2 of the embodiment includes a left frame side plate member 21 and a right frame side plate member 22 opposed to each other in parallel on the left and right sides of the printer width direction x. At an intermediate position in the back and forth direction of the printer in the frame side plate members 21 and 22, a guide shaft 23 extending in the printer width direction x is placed between the frame side plate members 21 and 22. A subguide shaft 24 extending in the printer width direction x, placed between the frame side plate members 21 and 22 is placed at a rear position of the guide shaft 23. The carriage 8 is mounted on the guide shaft 23 and the subguide shaft 24 in a state in which the carriage 8 can reciprocate in the printer width direction x along the shafts.

That is, the carriage 8 is formed with a through hole 25 through which the guide shaft 23 passes in a slidable state and is formed at the rear end with slide pieces 26 that can slide with the subguide shaft 24. At a lower position of the guide shaft 23, a cam shaft 27 extending in the printer width direction x is placed between the frame side plate members 21 and 22. The cam shaft 27 is formed on an outer peripheral surface with a spiral cam groove 27*a* along the axial direction and a cam follower 28 extending downward from the back of the carriage 8 is inserted into the cam groove 27*a* in a slidable state. The cam shaft 27 is rotated through a reduction gear train 30 by a carriage motor 29. As the cam shaft 27 rotates, the carriage 8 can move in the printer width direction x along the guide shaft 23 and the subguide shaft 24.

Figure 4:
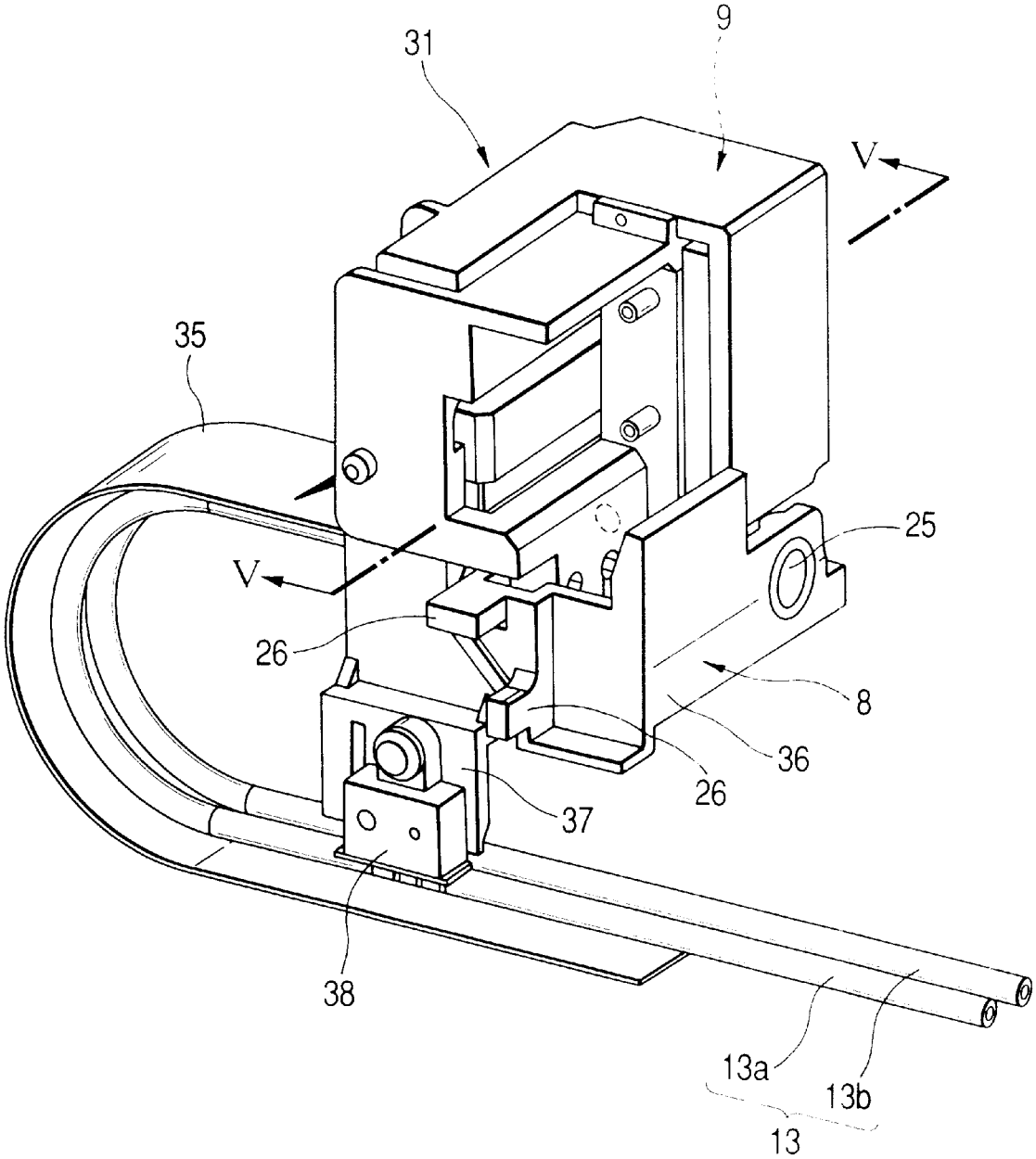
FIG. 4 is a perspective view of a carriage and a head unit in the ink jet printer in FIG. 1.
Figure 5:
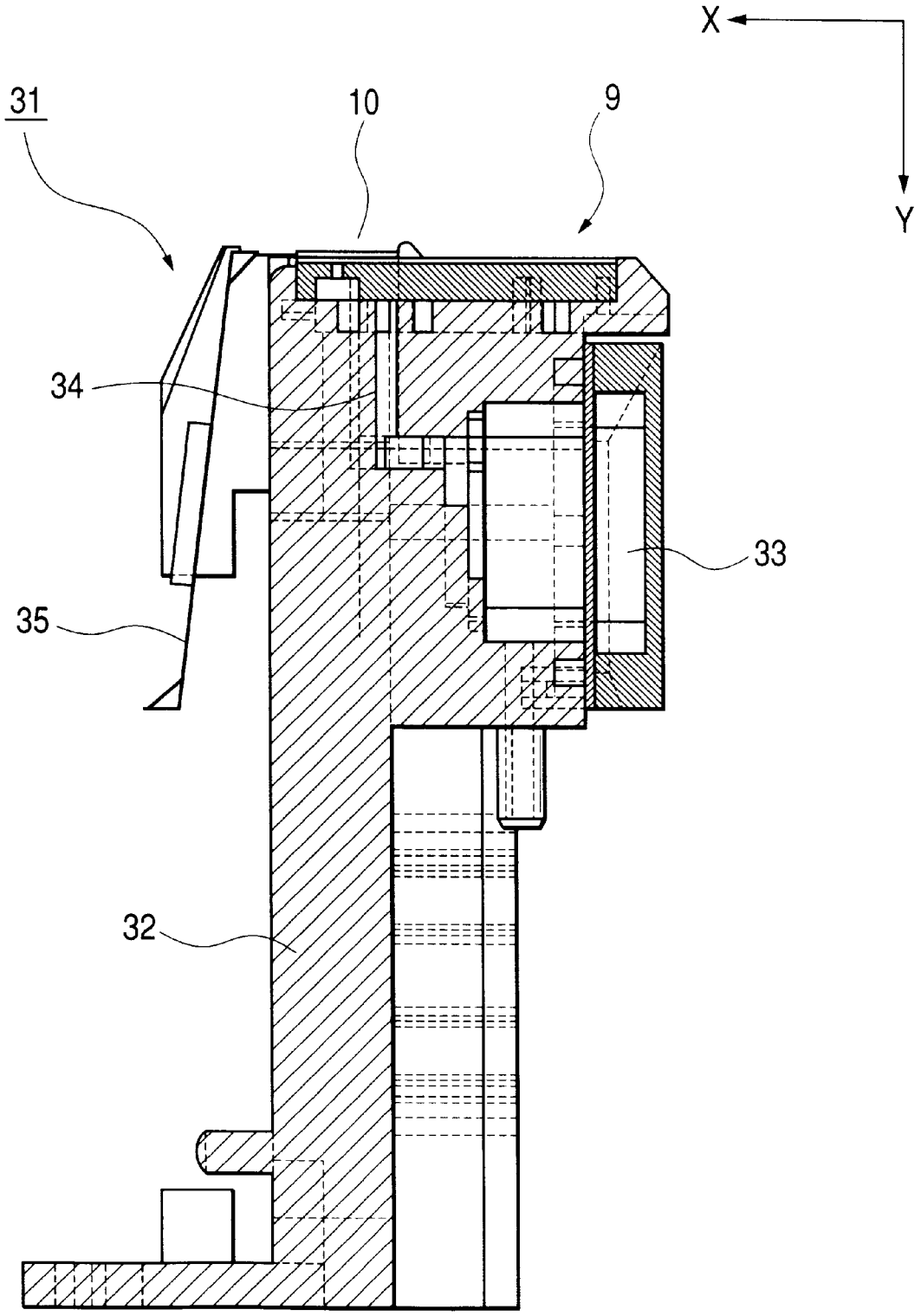
FIG. 5 is a fragmentary sectional view taken on line V—V in FIG. 4.

A head unit 31 is mounted on the described carriage 8. FIGS. 4 and 5 are a perspective view of the carriage 8 and the head unit 31 and a fragmentary sectional view. As shown in the figures, the head unit 31 comprises a unit case 32, the head chip 9 attached to the top of the unit case 32, a damper chamber 33 formed in the unit case 32, and an ink supply passage 34 formed in the unit case 32 for supplying ink to each ink nozzle (not shown) of the head chip 9. A flexible printed wiring board 35 formed with wiring for connecting the head chip 9 and an external circuit, and ink tubes 13 (13*a* and 13*b*) are drawn out from the unit case 32.

The carriage 8 comprises a main portion 36 on which the head unit 31 is mounted and the through hole 25 and the slide pieces 26 formed in the main portion 36. Further, an end face portion opposed to the ink supply section 12 in the main portion 36 of the carriage 8 comprises an attachment plate portion 37 extending downward, and an optical detector 38 comprising a light emission element and a light reception element is attached to the attachment plate portion 37.

Referring again to FIGS. 1 to 3, the carriage move space 11 for reciprocating the carriage 8 with the head unit 31 mounted thereon in the printer width direction x is formed between the left and right frame side plate members 21 and 22. The ink supply section 12 is placed between the frame side plate members 21 and 22 on the back of the carriage move space 11 and the recording paper transport section 3 is placed between the frame side plate members 21 and 22 on the front of the carriage move space 11.

Since the recording paper transport section 3 has a length shorter than the spacing between the left and right frame side plate members 21 and 22, on the left of the recording paper transport section 3, a side gap portion 41 is formed between the recording paper transport section 3 and the left frame side plate member 21. A back side gap portion 44 almost triangular in cross section extending in the printer width direction x, defined by a bottom 42 of the frame assembly 2 defined by the lower end faces of the frame side plate members 21 and 22 and a recording paper transport section back 43 is also formed on the back side of the recording paper transport section 3. In the embodiment, the side gap portion 41 and the back side gap portion 44 are used to place the head maintenance unit 14.

More particularly, the left frame side plate member 21 comprises a side plate portion 21*a*, a bottom plate portion 21*b* bent in the right angle from the lower end and extending to the right frame side plate member 22, and an attachment plate portion 21*c* upright at the right angle from the tip of the bottom plate portion 21*b* and extending upward. The right frame side plate member 22 comprises a side plate portion 22*a* and a bottom plate portion 22*b* bent in the right angle from the lower end and extending to the left frame side plate member 21. The bottom 42 of the printer frame assembly 2 is defined by the backs of the bottom plate portions 21*a* and 22*b*.

The recording paper transport section 3 comprises a recording paper guide plate 51 attached to the right frame side plate member 22 and a recording paper transport unit 52 placed on the recording paper guide plate 51 from the top in a printer thickness direction z. The recording paper guide plate 51 is bent almost like a V letter open upward in cross section. It comprises a bottom plate portion Sa extending in parallel to the bottom 42 of the frame assembly 2 at an upper position of the bottom 42, a vertical plate portion 51*b* in an upright position from the rear margin of the bottom plate portion 51*a*, and an inclined plate portion 51*c* extending in an upward slanting direction from the front margin of the bottom plate portion 51*a* toward the front (in other words, inclined upward as it is away from the side of the carriage move space).

The described recording paper guide plate 51 is fixed at both ends to the attachment plate portion 21*c* of the left frame side plate member 21 and the side plate portion 22*a* of the right frame side plate member 22. A guide plate 53 made of a thin plate comprising a spring and having projections 53*a* projected upward at both ends is attached to the front end face of the vertical plate portion 51*b* so as to slightly narrow the angle with the inclined plate portion 51*c*. From the guide plate 53, a driven roller 54 for transporting recording paper slightly projects toward the front of the printer. The back side gap portion 44 is formed by the bottom plate portion 51*a* of the recording paper guide plate 51 and a back 51*d* of the inclined plate portion 51*c*. Further, a paper feed motor 50 attached to the right frame side plate member 22 is placed on the lower side on the right end side in the recording paper guide plate 51.

In contrast, the recording paper transport unit 52 comprises a unit base 55 having such a contour shape to bridge the upper part of the recording paper guide plate 51 bent like a V letter in cross section. The platen plate 7 is attached to the unit base 55. A recording paper transport roller 56 is attached to the tapered lower end part of the unit base 55 for rotation, and the front face of the unit base 55 is a recording paper guide face 57 inclined in an upward slanting direction from the lower end part.

With the recording paper transport unit 52 placed on the recording paper guide plate 51, the recording paper guide face 57 on the unit side is opposed to the inclined plate portion 51*c* of the recording paper guide plate 51, the driven roller 54 is pressed against the recording paper transport roller 56, and the projection 53*a* of the guide plate 53 is pressed against the platen plate 7 in the upright position by a slight force. Accordingly, the recording paper transport passage 4 shaped like a V letter is formed. A driven gear 58 attached to the right end of the rotation shaft of the recording paper transport roller 56 meshes with a drive gear 59 attached to the rotation shaft of the paper feed motor 50. Thus, the recording paper transport roller 56 is rotated by the paper feed motor 50 for transporting recording paper via the print position 6 along the recording paper transport passage 4.

Figure 6:
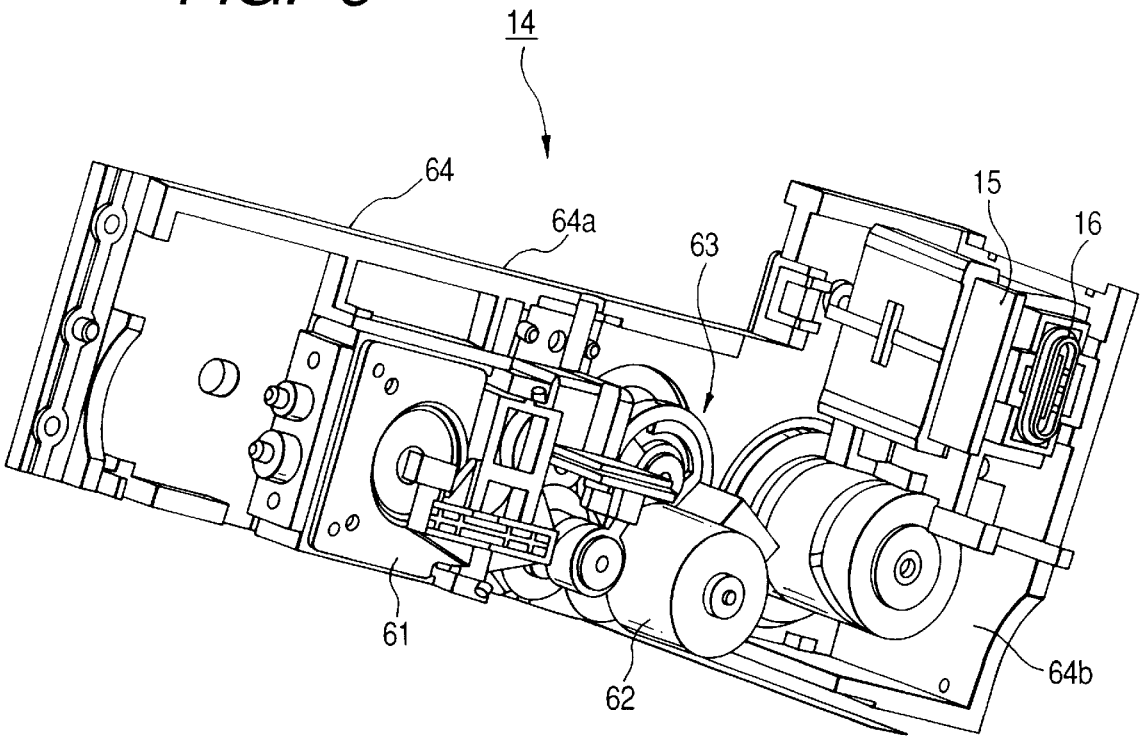
FIG. 6 is a perspective view of a head maintenance unit in the ink jet printer in FIG. 1.
Figure 7:
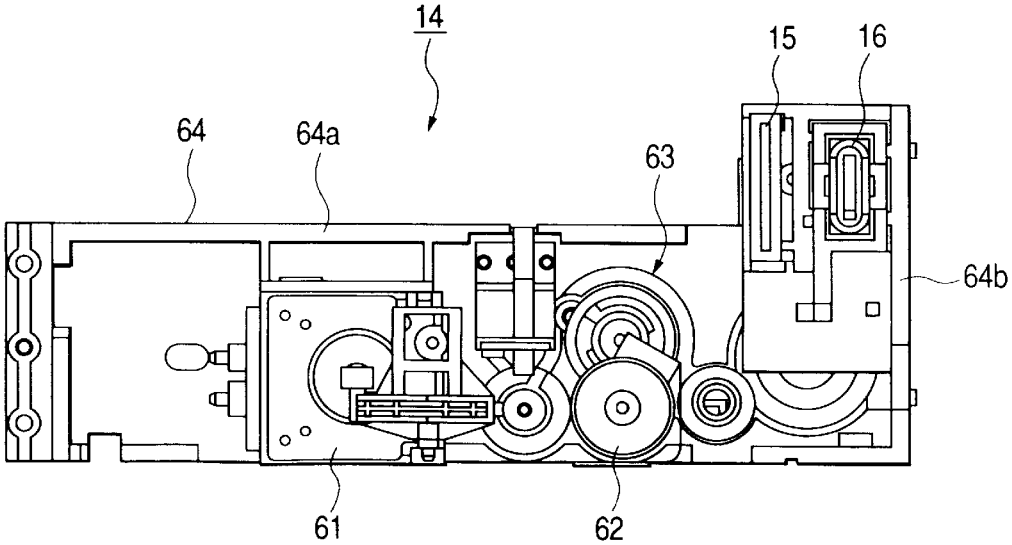
FIG. 7 is a front view of the head maintenance unit in FIG. 6 from the back of the printer.

Next, FIGS. 6 and 7 are a perspective view and a front view of the head maintenance unit 14 from the back. Referring to the figures, the head maintenance unit 14 comprises the head cap 16 and the wiper 15 placed in the side gap portion 41, and a waste ink pump 61, a motor 62, and a power transmission mechanism 63 for transmitting the rotation power of the motor 62 to the waste ink pump 61, the wiper 15, and the head cap 16. The waste ink pump 61, the motor 62, and the power transmission mechanism 63 are placed in the back side gap portion 44.

The head maintenance unit 14 of the embodiment comprises a unit base 64 placed between the left and right frame side plate members 21 and 22, and the parts 15, 16, 61, 62, and 63 are mounted on the unit base 64.

The unit base 64 of the embodiment is shaped roughly like an L letter comprising an end plate portion 64*a* whose outer face becomes the front end face of the ink jet printer 1 when the unit base 64 is placed in the frame assembly 2, and a side plate portion 64*b* bent at the right angle and extending along the side plate portion 21*a* of the frame side plate member 21 from the end of the end plate portion 64*a* on the side of the frame side plate member 21. The waste ink pump 61, the motor 62, and the power transmission mechanism 63 are installed inside the end plate portion 64*a*, and the head cap 16 and the wiper 15 are installed on the side plate portion 64*b*.

Next, the ink supply section 12 of the embodiment is placed between the left and right frame side plate members 21 and 22 and comprises an ink cartridge holder 71 shaped like a rectangular box with the top opened and two ink cartridges 72 and 73 detachably placed in the ink cartridge holder 71 from above. Left and right side plate portions 71*a* and 71*b* of the ink cartridge holder 71 are attached to the side plate portions 21*a* and 22*a* of the left and right frame side plate members 21 and 22. A bottom plate portion 71*c* of the ink cartridge holder 71 is positioned on the same plane as the bottom plate portions 21*b* and 22*b* of the frame side plate members 21 and 22 and defines the bottom 42 of the frame assembly 2. Further, an end plate portion 71*d* on the back of the ink cartridge holder 71 is perpendicular to the sides of the frame side plate members 21 and 22 and defines the rear end face of the ink jet printer 1.

Figure 8:
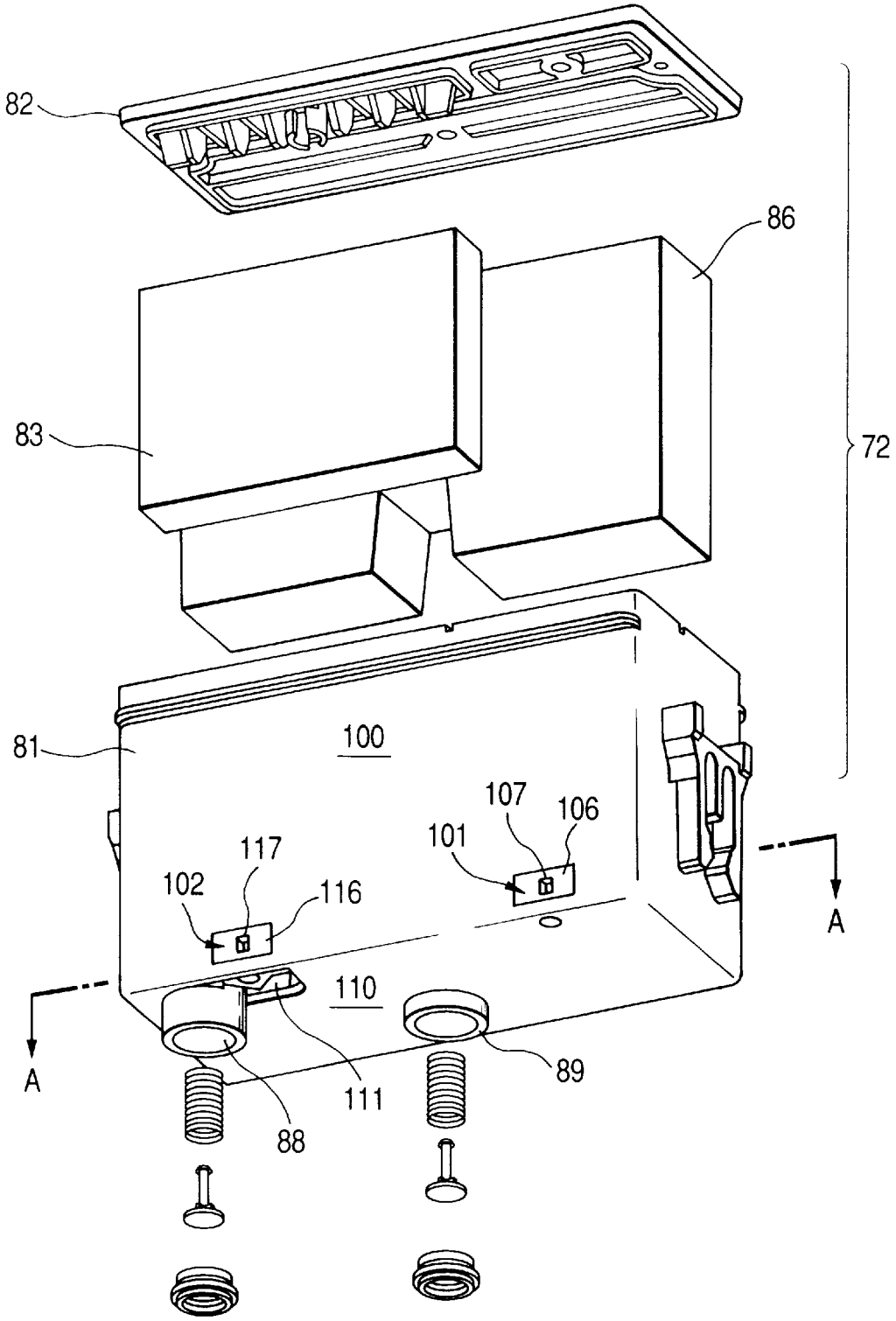
FIG. 8 is an exploded perspective view of an ink cartridge in the ink jet printer in FIG. 1.
Figure 9:
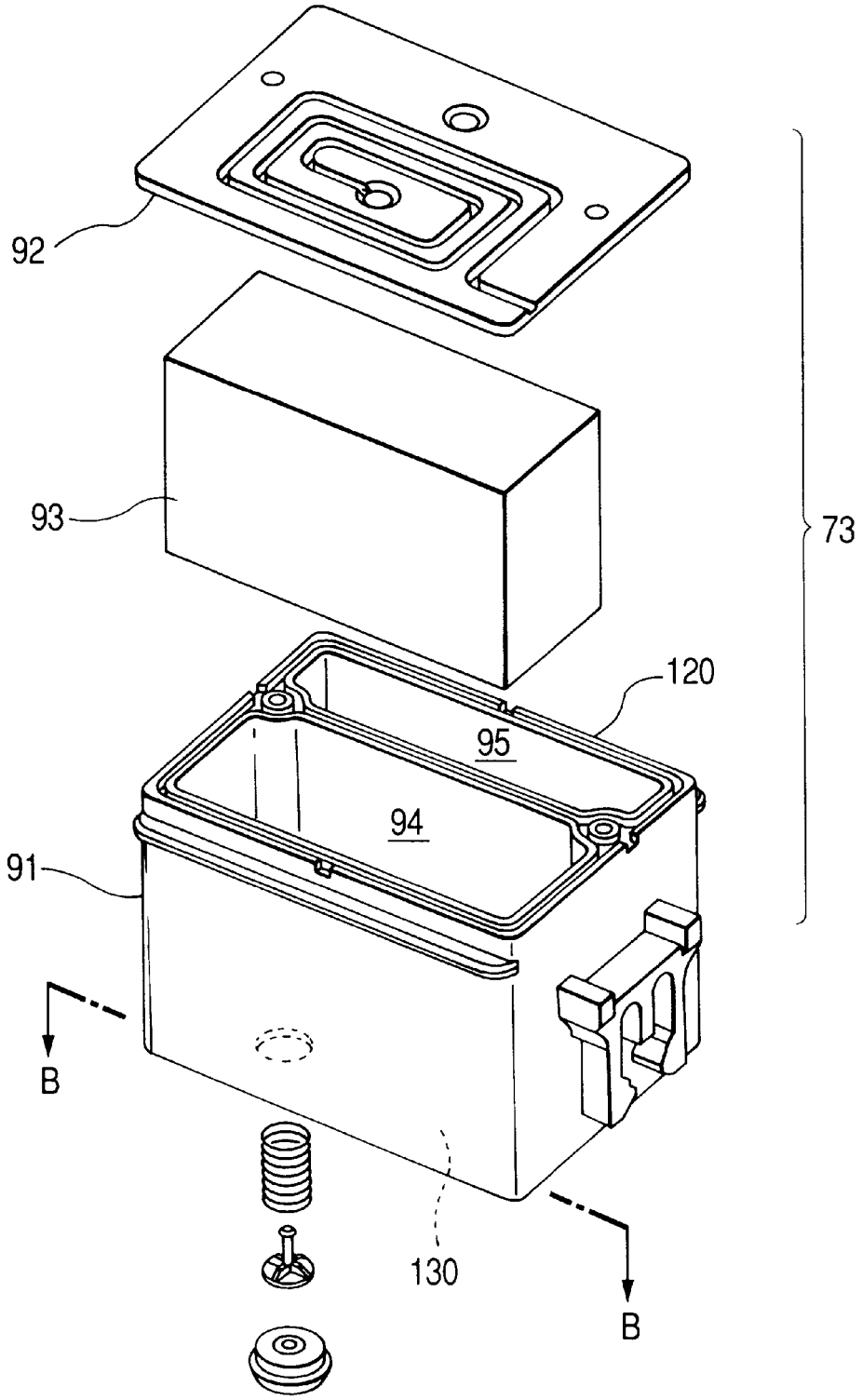
FIG. 9 is an exploded perspective view of an ink cartridge in the ink jet printer in FIG. 1.
Figure 10:
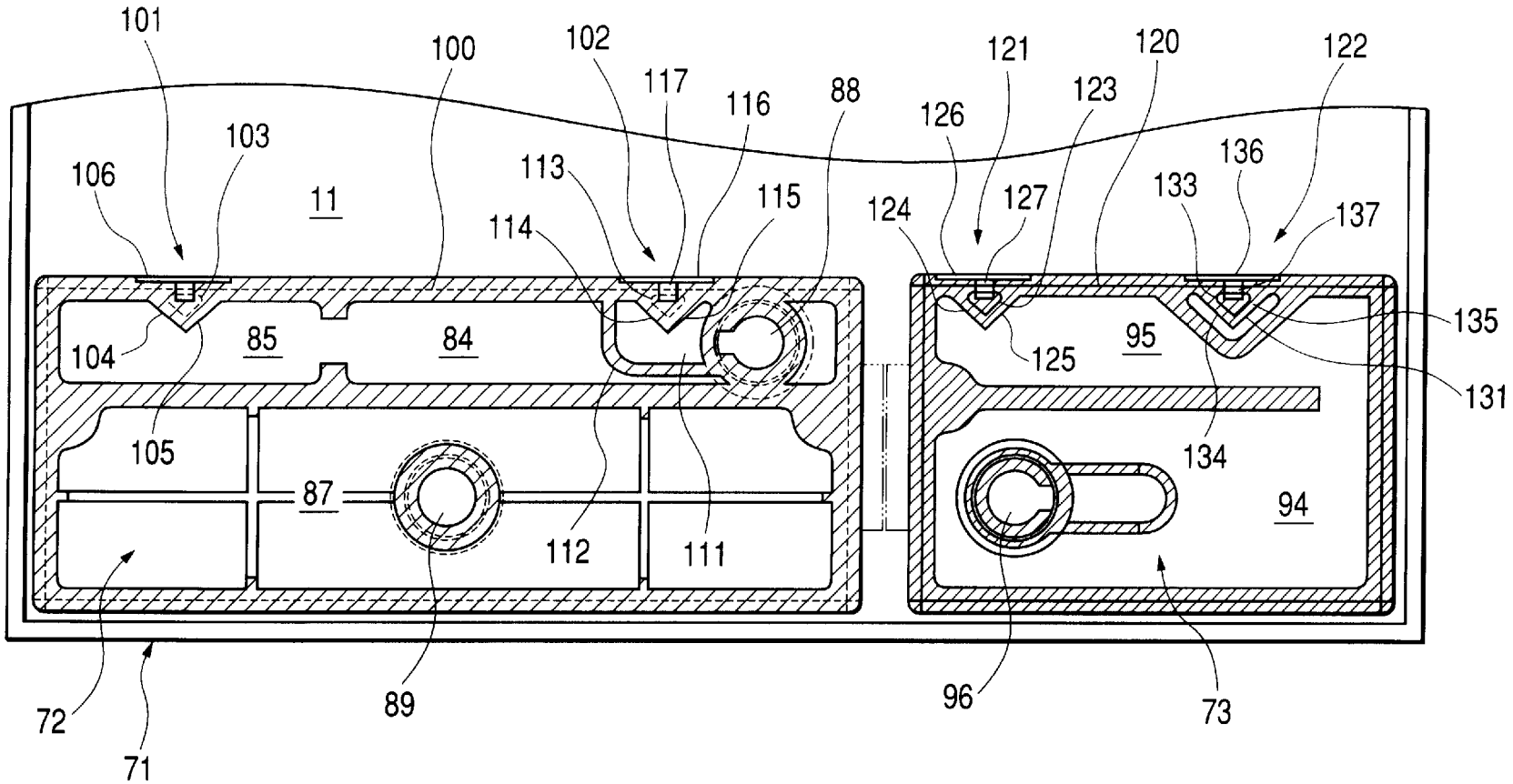
FIG. 10 is a sectional view taken on line A—A in FIG. 8 and line B—B in FIG. 9.

FIGS. 8 and 9 are exploded perspective views of the ink cartridges 72 and 73 respectively. FIG. 10 is a sectional view taken on line A—A in FIG. 8 and line B—B in FIG. 9 in a state in which the ink cartridges 72 and 73 are placed in the ink cartridge holder 71.

To begin with, referring to FIGS. 8 and 10, the ink cartridge 72 is a color ink cartridge storing color ink and comprises a case main body 81 and a case lid 82. The case main body 81 contains a color ink reservoir 84 storing color ink with which an absorption body 83 is filled, a color ink reservoir 85 storing color ink in liquid form, and a waste ink collection chamber 87 for collecting waste ink in a contained ink absorption body 86. The color ink reservoirs 85 and 84 are separated from each other in the upper portions and communicate with each other at a position in the vicinity of the bottom.

The case main body 81 is formed in the bottom portion with an ink supply port 88 in the portion where the color ink reservoir 84 is positioned and a waste ink collection port 89 in the portion where the waste ink collection chamber 87 is positioned. When the ink cartridge 72 is placed in the ink cartridge holder 71, the ink supply port 88 and the waste ink collection port 89 communicate with a color ink supply section (not shown) and a waste ink collection section (not shown) formed on the bottom of the ink cartridge holder 71.

Next, referring to FIGS. 9 and 10, the ink cartridge 73 will be discussed. The ink cartridge 73 is a black ink cartridge storing black ink and comprises a case main body 91 and a case lid 92. The case main body 91 contains a black ink reservoir 94 storing black ink with which an absorption body 93 is filled, and a black ink reservoir 95 storing black ink in liquid form; these communicate with each other at a position in the vicinity of the bottom. A black ink supply port 96 is formed in the bottom portion of the case main body 91 where the black ink reservoir 94 is positioned. When the ink cartridge 73 is placed in the ink cartridge holder 71, the ink supply port 96 communicates with a black ink supply section (not shown) formed on the bottom of the ink cartridge holder 71.

When the ink cartridges 72, 73 are thus placed, an ink supply passage to the head chip 9 is formed via the ink tube 13*a*, 13*b* and at the same time, a waste ink collection passage for collecting waste ink collected in the head maintenance unit 14 is formed.

The frame assembly 2 of the ink jet printer 1 of the embodiment described above is made up of the left and right frame side plate members 21 and 22, the unit base 64 of the head maintenance unit 14 attached to the front end face of the printer, and the ink cartridge holder 71 of the ink supply section 12 attached to the rear end of the printer. The head maintenance unit 14 is placed so that it is put in the rectangular frame assembly 2 using the back side gap portion 44 formed between the back of the recording paper guide plate 51 of the recording paper transport section 3 and the bottom 42 of the frame assembly 2 and the side gap portion 41 formed between the recording paper transport section 3 and the frame side plate member 21.

Therefore, in the ink jet printer 1, the recording paper transport section 3 and the ink supply section 12 are placed compactly in front and rear with the move space 11 of the carriage 8 between, and using the empty spaces on the back and side of the recording paper transport section 3, the head maintenance unit 14 is placed compactly. Therefore, a flat and small-sized ink jet printer can be provided.

In the embodiment, the recording paper transport mechanism and the portion for head maintenance requiring maintenance and inspection are put into units. Therefore, although the printer is small-sized, assembly work is easy to perform and disassembly and assembly at maintenance and inspection time are also easy to perform.

(Ink Cartridge Detection Mechanism)

Next, the ink jet printer 1 of the embodiment comprises a detection mechanism for detecting the ink cartridges 72 and 73 being placed in the ink jet holder 71 and detecting the presence or absence of ink in the ink cartridges 72 and 73. The detection mechanism of the embodiment is made up of the single optical detector 38 attached to the carriage 8 and a plurality of detected parts 101 and 102 and 121 and 122 formed on the ink cartridges 72 and 73.

As seen in FIGS. 8 and 10, the two detected parts 101 and 102 are formed on a front wall portion 100 of the color ink cartridge 72 of the embodiment on the side of the carriage move space 11. The detected parts 101 and 102 are formed away from each other along the move direction of the optical detector 38, namely, the carriage move direction x and are positioned within the detection area of the optical detector 38.

The detected part 101 comprises a right-angle prism 103 provided by projecting a bottom side portion of the front wall portion 100 made of a plastic material having a light transmission property to the inside. Two reflection faces 104 and 105 orthogonal to each other in the right-angle prism 103 are exposed to the interior of the color ink reservoir 85. An irregular reflection prevention face 106 sized to include the reflection faces 104 and 105 is formed on the surface side of the front wall portion 100 where the right-angle prism 103 is formed. Further, the rectangular irregular reflection prevention face 106 is formed at the center with a rectangular recess part 107.

The other detected part 102 also comprises a right-angle prism 113 provided by projecting a bottom side portion of the front wall portion 100 to the inside. A bottom plate portion 110 of the case main body 81 contiguous to the front wall portion 100 where the right-angle prism 113 is formed with an almost rectangular recess part 111 in the portion adjacent to a peripheral wall portion 88*a* of the ink supply port 88. Therefore, the inner and outer faces of the end plate portion where the right-angle prism 113 is formed are exposed to the exterior of the color ink reservoir 84. That is, a gap is formed between two reflection faces 114 and 115 orthogonal to each other in the right-angle prism 113 and a recess part lateral wall portion 112 forming a part of a lateral wall portion of the color ink reservoir 84.

An irregular reflection prevention face 116 sized to include the reflection faces 114 and 115 is formed on the surface side of the front wall portion 100 where the right-angle prism 113 is formed. Further, the rectangular irregular reflection prevention face 116 is formed at the center with a rectangular recess part 117.

Next, the two detected parts 121 and 122 are also formed on a front wall portion 120 of the black ink cartridge 73 on the side of the carriage move space 11. The detected parts 121 and 122 are formed away from each other along the move direction of the optical detector 38, namely, the carriage move direction x and are positioned within the detection area of the optical detector 38.

The detected part 121 has the same structure as the detected part 101 and comprises a right-angle prism 123 provided by projecting a bottom side portion of the front wall portion 120 to the inside. Two reflection faces 124 and 125 orthogonal to each other in the right-angle prism 123 are exposed to the interior of the black ink reservoir 95. An irregular reflection prevention face 126 sized to include the reflection faces 124 and 125 is formed on the surface side of the front wall portion 120 where the right-angle prism 123 is formed. Further, the rectangular irregular reflection prevention face 126 is formed at the center with a rectangular recess part 127.

The other detected part 122 also comprises a right-angle prism 133 provided by projecting a bottom side portion of the front wall portion 120 to the inside. The right-angle prism 133 is formed by projecting the bottom side portion of the front wall portion 120 to the inside like a right triangle and forming in the part an L-shaped recess part 131 from the side of a bottom plate portion 130 of the case main body 91. The right-angle prism 133 comprises two reflection faces 134 and 135 orthogonal to each other. Therefore, the reflection faces 134 and 135 of the right-angle prism 133 are not directly exposed to ink and a gap is always provided by the recess part 131.

An irregular reflection prevention face 136 sized to include the reflection faces 134 and 135 is formed on the surface side of the front wall portion 120 where the right-angle prism 133 is formed. Further, the rectangular irregular reflection prevention face 136 is formed at the center with a rectangular recess part 137.

Figure 11A:
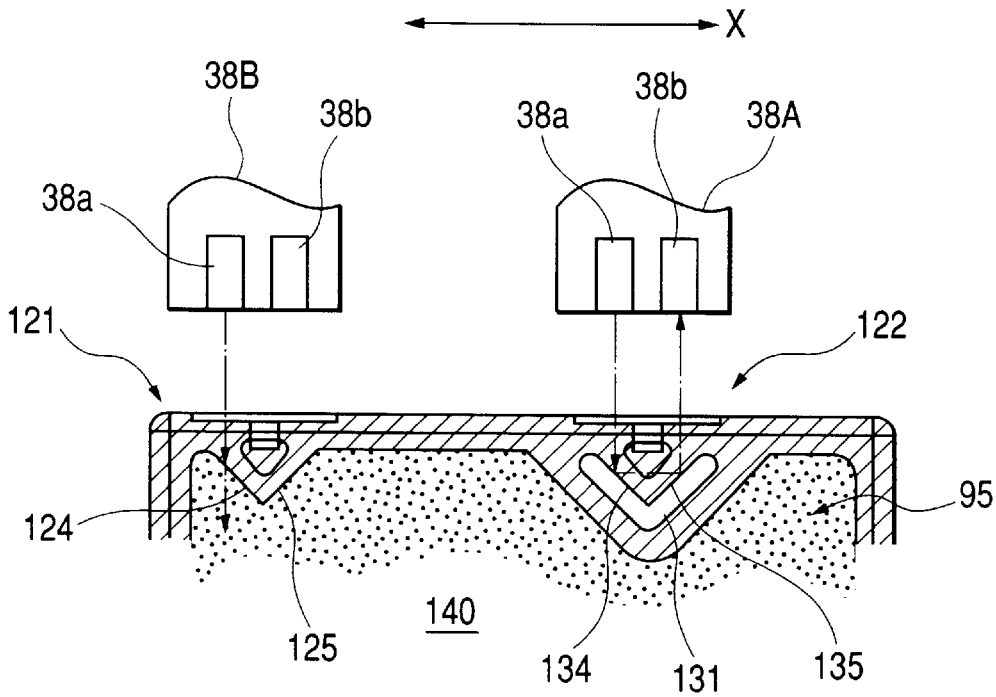
FIGS. 11(A) and 11(B) are schematic representations to describe the operation of an optical detector mounted on a carriage for detecting detected parts formed on the ink cartridges.
Figure 11B:
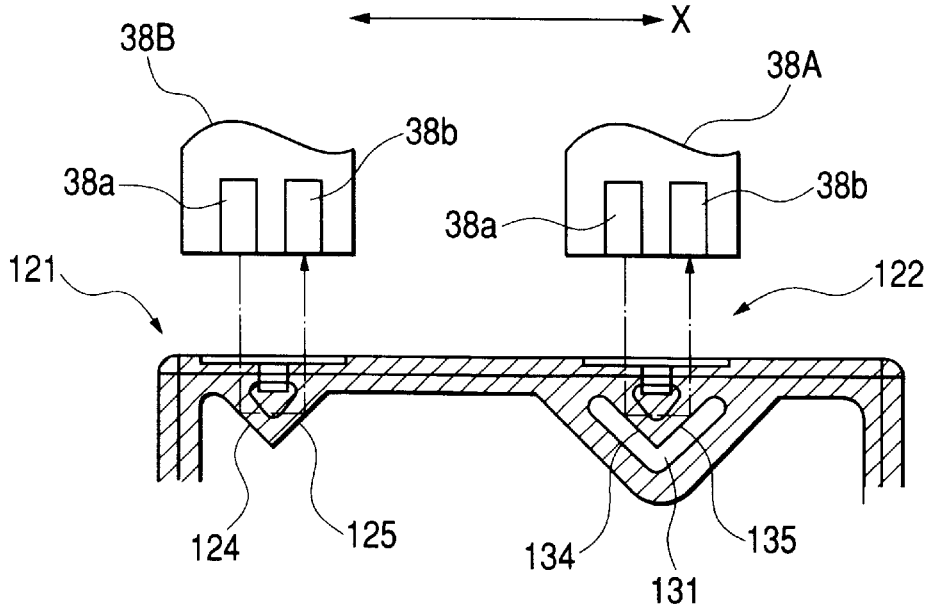

Of the detected parts 101, 102, 121, and 122, the detected parts 101 and 121 are provided for indicating the presence or absence of ink in the color ink cartridge 72 and the black ink cartridge 73. Taking the detected part 121 as an example, as shown in FIG. 11(*a*), when the black ink reservoir 95 contains ink, the two reflection faces 124 and 125 orthogonal to each other are immersed in ink 140 and thus do not function as reflection faces. Thus, when the optical detector 38 mounted on the carriage 8 is opposed to the detected part 121 (position 38B), light emitted from the light emission element 38*a* is not reflected on the reflection face 124 and the light reception element 38*b* does not receive reflected light.

In contrast, as shown in FIG. 11(*b*), when the black ink reservoir 95 becomes empty of ink, the two prism reflection faces 124 and 125 orthogonal to each other function as reflection faces. Thus, at the position 38B, light emitted from the light emission element 38*a* of the detector 38 is reflected on the reflection faces 124 and 125 and is incident on the light reception element 38*b*. Therefore, the presence or absence of ink can be detected based on the light reception amount at the light reception element 38*b*.

Next, the detected parts 102 and 122 are provided for detecting the color ink cartridge 72 and the black ink cartridge 73 being placed in the ink cartridge holder 71. Taking the detected part 122 as an example, as shown in FIG. 11, the gap (recess part 131) is formed on the rear side of the two reflection faces 134 and 135 orthogonal to each other and thus the reflection faces always have a reflection function regardless of whether or not ink exists. Thus, if the black ink cartridge 73 is placed in the ink cartridge holder 71, when the optical detector 38 is opposed to the detected part 122 (position 38A), the detector 38 detects reflected light. If the black ink cartridge 73 is not placed, no reflected light is detected. Therefore, the presence or absence of the ink cartridge can be detected based on the light reception amount at the light reception element 38*b*.

Figure 12:
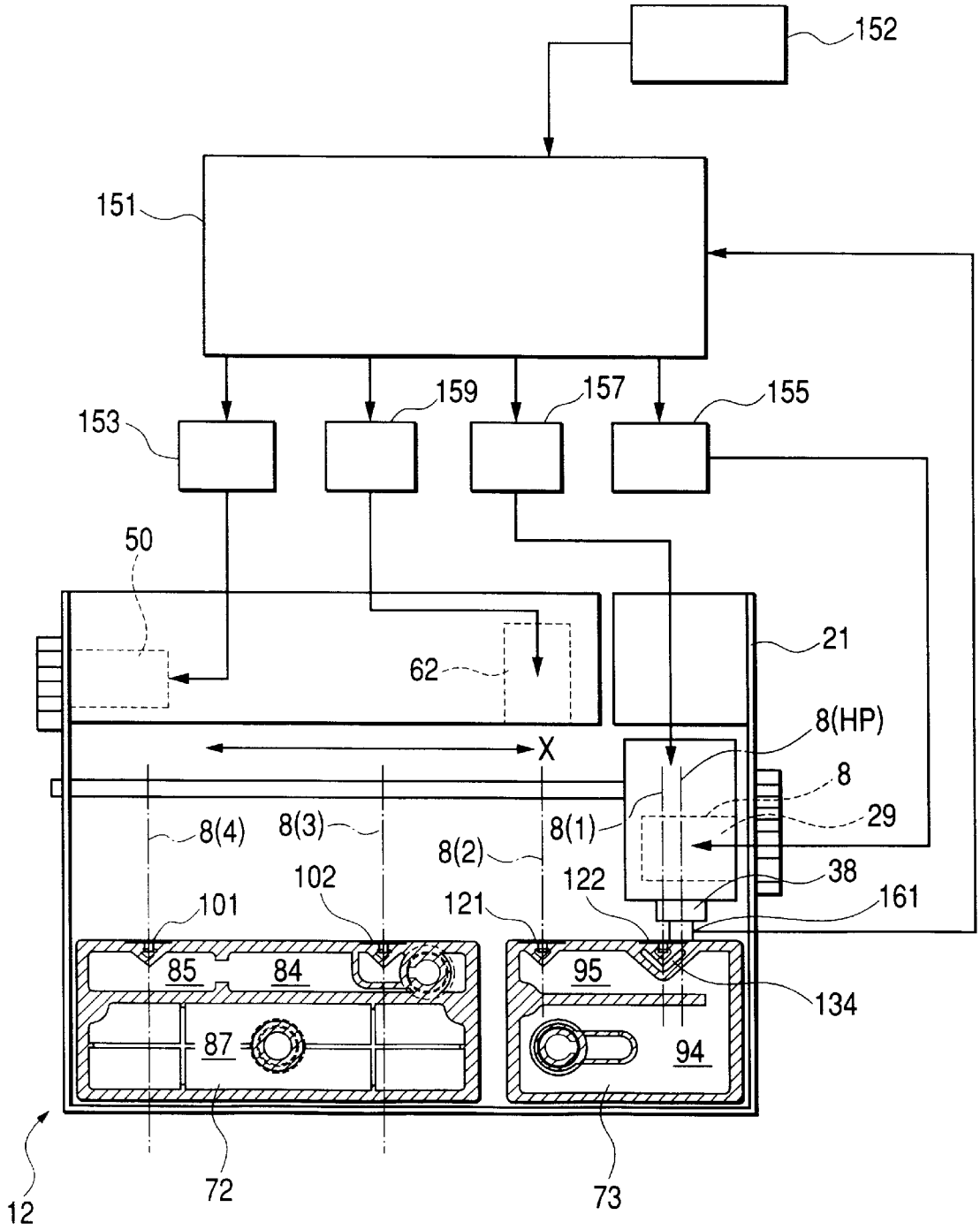
FIG. 12 is a schematic block diagram of a drive control system of the ink jet printer in FIG. 1.

Next, FIG. 12 is a schematic block diagram to show a drive control system of the ink jet printer 1 of the embodiment. The drive control system comprises a control section 151 configured centering on a computer containing a CPU, ROM, RAM, etc., and print information is supplied from an external system 152 to the control section 151. The control section 151 drives the paper feed motor 50 through a driver 153 based on the supplied print information for transporting recording paper (not shown) to the print position 6. The control section 151 also drives the carriage motor 29 through a driver 155 for moving the carriage 8 on which the head chip 9 is mounted in the printer width direction x. Further, the control section 151 drives the ink jet head built in the head chip 9 at a predetermined timing through a head driver 157 for performing predetermined print on the surface of the recording paper passing through the print position. In addition, maintenance processing of the ink jet head is also performed. As a non-limiting example, the maintenance processing may contain processing of moving the carriage 8 to the home position where the head cap 16 of the head maintenance unit 14 is positioned and ink droplets are ejected from each nozzle of the ink jet head or performing a suction operation of ink from each ink nozzle with the head cap 16 put on the nozzle face of the ink jet head. The motor 62 as the drive source for the maintenance processing is also driven through a driver 159.

The control section 151 detects the carriage 8 being positioned at the home position 8(HP) by a sensor 161 placed at the home position 8 (HP). The control section 151 detects each of positions 8(1) to 8(4) on the move passage of the carriage 8 based on the number of steps of the carriage motor 29 or the like, for example, with the home position 8(HP) as the reference. The position 8(1) is a position at which the optical sensor 38 mounted on the carriage 8 is opposed to the detected part 122 of the black ink cartridge 73; the position 8(2) is a position opposed to the detected part 121; the position 8(3) is a position at which the optical sensor 38 is opposed to the detected part 102 of the color ink cartridge 72; and the position 8(4) is a position opposed to the detected part 101.

When the carriage 8 is placed at the positions 8(1) to 8 (4), the control section 151 determines whether or not the ink cartridges 73 and 72 are placed and the presence or absence of ink in the ink cartridges 73 and 72 based on a detection signal of the optical detector 38.

As described above, in the ink jet printer 1 of the embodiment, the ink cartridge 72 is formed on one side with the detected parts 101 and 102 each comprising a right-angle prism and the ink cartridge 73 is formed on one side with the detected parts 121 and 122 each comprising a right-angle prism. The detected parts are detected by the common optical detector 38 mounted on the carriage 8, whereby whether or not the ink cartridges 73 and 72 are placed and the presence or absence of ink in the ink cartridges 73 and 72 are determined.

In the related art, to detect such four types of information, four detection mechanisms need to be placed. However, this embodiment makes it possible to provide a similar function by using only the four detected parts and the single detector. Therefore, the invention is advantageous for cost reduction and miniaturization of an ink jet printer.

(Other Embodiments)

Figure 13:
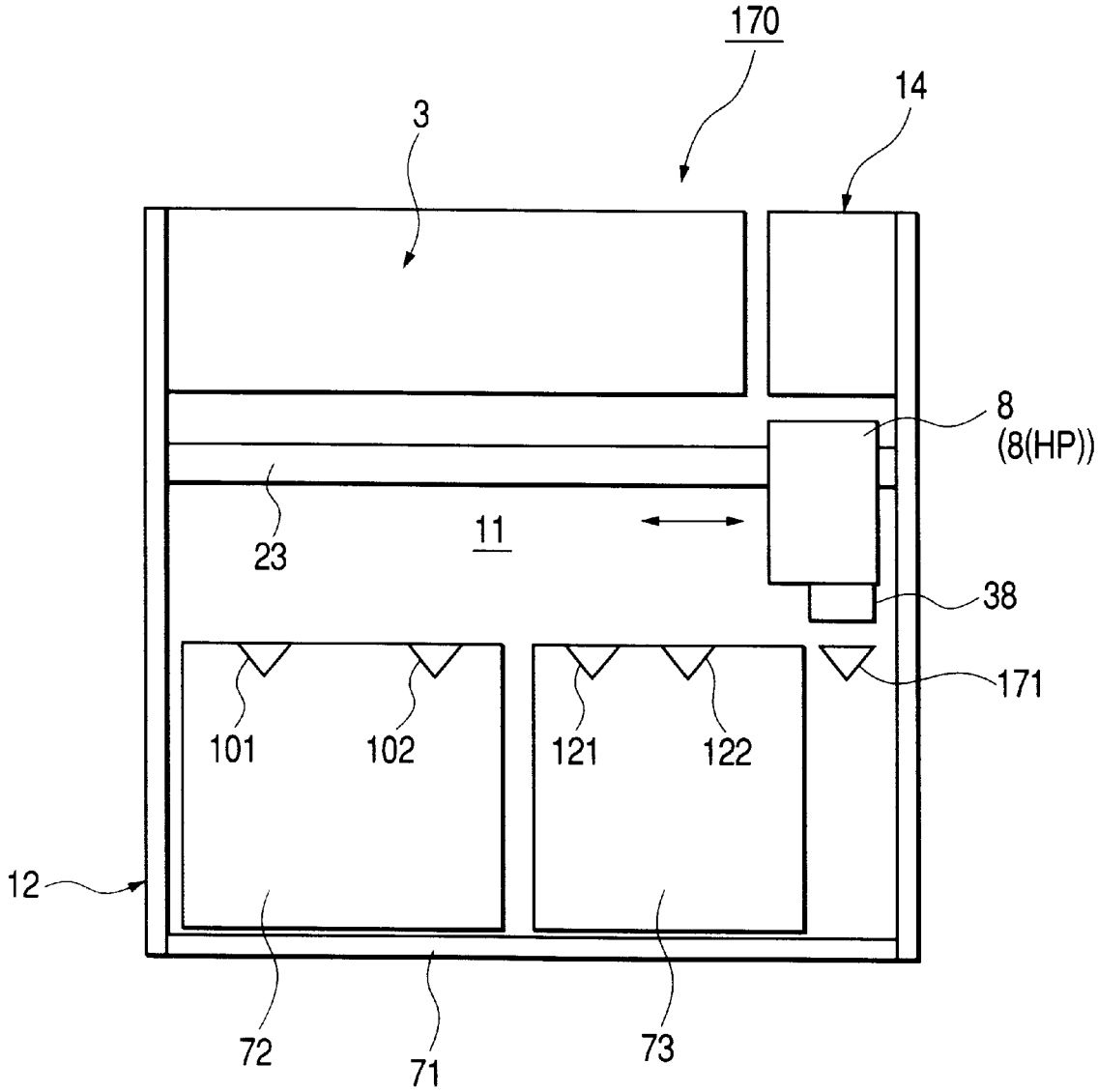
FIG. 13 is a schematic representation to show a modification of the ink jet printer in FIG. 1.

In the above-described embodiment, the mechanism for detecting the carriage being positioned at the home position is not specifically described. As such a detection mechanism, an optical detection mechanism, a mechanical detection mechanism, etc., can be adopted. However, it is desirable that the configuration shown in FIG. 13 be used. Parts identical with or similar to those of the ink jet printer 1 previously described with reference to the accompanying drawings are denoted by the same reference numerals in FIG. 13. In an ink jet printer 170 shown in the figure, a detected part 171 made of a right-angle prism for detecting a home position is placed on a slightly inner side from the return point of an optical detector 38 mounted on a carriage 8. In the configuration, when a carriage motor 29 is rotated in one direction and the carriage 8 is reciprocated in a printer width direction x by a cam shaft 27 comprising an endless cam groove 27*a*, two successive detection signals of the detected part 171 are detected in the vicinity of the return point at a side of the detected part 171. Since the interval between the detection signals of the detected part 171 is shorter than that between detection signals of detected parts 101 and 102 of an ink cartridge 72 or detected parts 121 and 122 of an ink cartridge 73, the carriage 8 being positioned at the home position 8(HP) can be detected, so that the mechanism for detecting the home position of the carriage 8 can be made simple.

In this embodiment, the cam groove 27*a* is shaped in a spiral and is formed endless so that the carriage is reciprocated in the printer width direction x as the cam shaft 27 rotates in one direction. If the cam groove is not formed in an endless manner, the carriage 8 is reciprocated by changing the carriage motor 29 rotation direction. In this case, it is also possible to rotate the carriage motor 29 a predetermined number of steps for abutting the carriage 8 against a frame side plate member 21, and then change the rotation direction of the carriage motor 29 and adopt the position at which the first detection signal is detected as the home position.

Figure 14A:
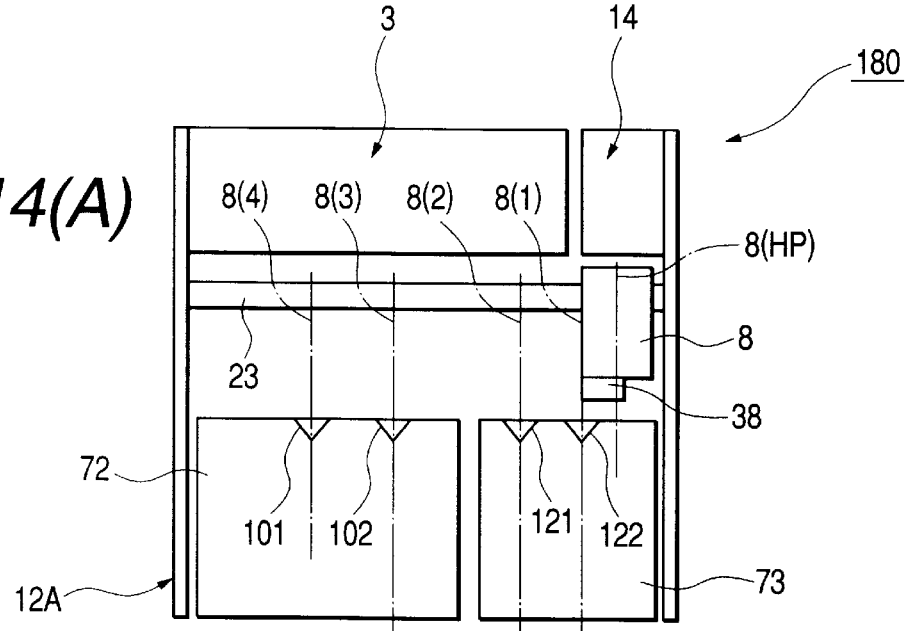
FIG. 14 is a schematic representation to show another embodiment of the ink jet printer in FIG. 1.
Figure 14B:
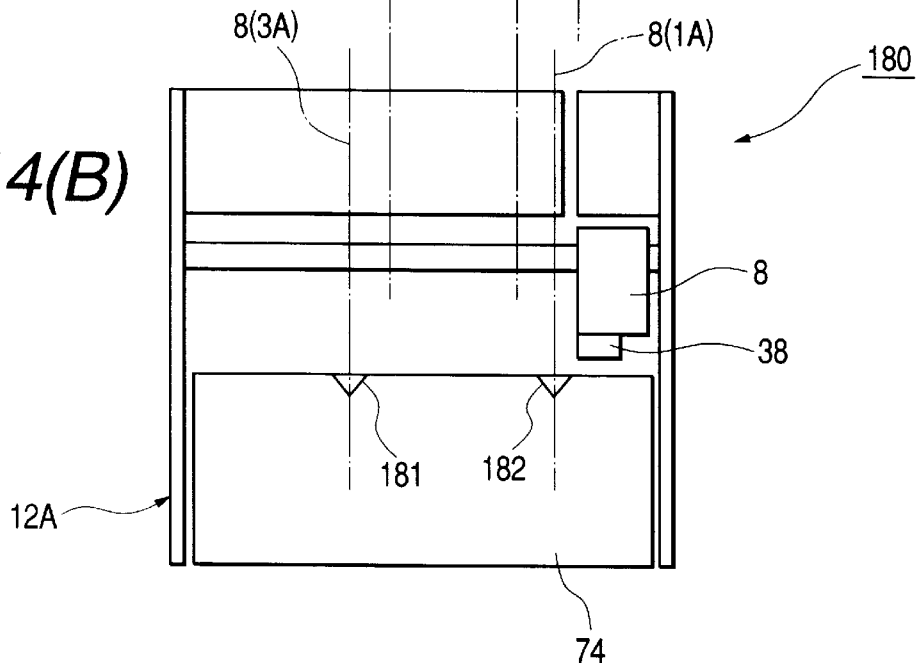

Next, the description of the ink jet printer 1 assumes that the two types of ink cartridges 72 and 73 are placed. However, the present invention includes an ink supply section in which three types of ink cartridges can also be installed. FIGS. 14(*a*) and (*b*) show an ink jet printer 180 comprising such an ink supply section 12A. Parts identical with or similar to those of the ink jet printer 1 previously described with reference to the accompanying drawings are denoted by the same reference numerals in FIGS. 14(*a*) and (*b*). A color ink cartridge 72 and a black ink cartridge 73 can be placed in the ink supply section 12A as shown in FIG. 14(*a*) and a single black ink cartridge 74 shown in FIG. 14(*b*) can also be placed in the ink supply section 12A. When the two ink cartridges 72 and 73 are placed, multicolor print is executed; when the single ink cartridge 74 is placed, single-color print is executed. To thus switch the print mode, it is necessary to determine whether or not the ink cartridge 74 is placed. To do this, in the embodiment, the ink cartridge 74 is formed with a detected part 182 for indicating that the ink cartridge 74 is placed and a detected part 181 for indicating the presence or absence of ink in the ink cartridge 74. The detected part 182 can have the same configuration as the above-described detected part 102, 122 and the detected part 181 can have the same configuration as the above-described detected part 101, 121.

In the embodiment, however, the detected part 182 is formed at a position where it is opposed to an optical detector 38 mounted on a carriage 8 when the carriage 8 reaches a position 8(1A) between positions 8(1) and 8(2). Therefore, whether or not the ink cartridge 74 is placed can be determined based on an output signal of the optical detector 38 when the carriage 8 is placed at the position 8(1A). The print mode can be switched into either of multicolor print and single-color print based on the determination result.

Thus, the ink jet printer 180 of the embodiment eliminates the need for operating a DIP switch, etc., placed on a printer controller for switching the print mode as in the related art, so that the detrimental effects caused by the user who forgets to operate the switch can be avoided. Accordingly, it is made possible to determine the print mode using this configuration.

In the embodiment, a position 8(3A) of the detected part 181 formed on the ink cartridge 74 is also different from positions 8(1) to 8(4). Therefore, a detection signal of the optical detector 8 is determined at the six carriage move positions. However, the detected part 181 is provided for detecting the presence or absence of ink and thus if the position of the detected part 181 is set to the same position as any of the positions 8(1) to 8(4), no problem arises; detection can also be made with the position difference of the positions 8(1) to 8(4).

Next, this detection process is described in more detail using FIGS. 15 and 16 hereinbelow.

Figure 15:
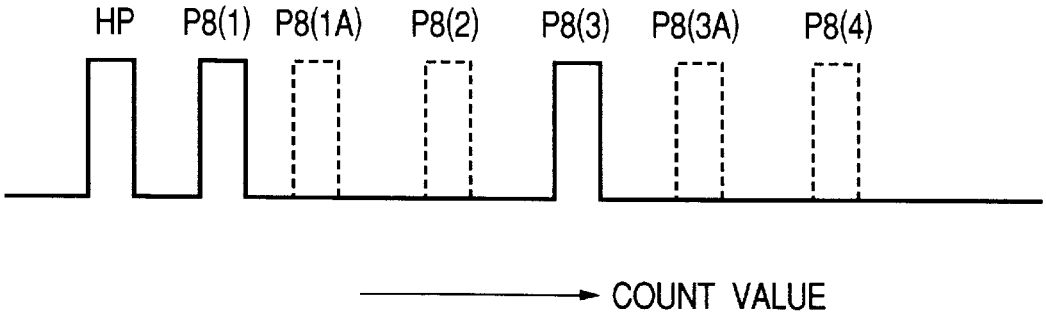
FIG. 15 is a pulse timing chart based on a waveform detected by the optical detector shown in FIG. 14.
Figure 16:
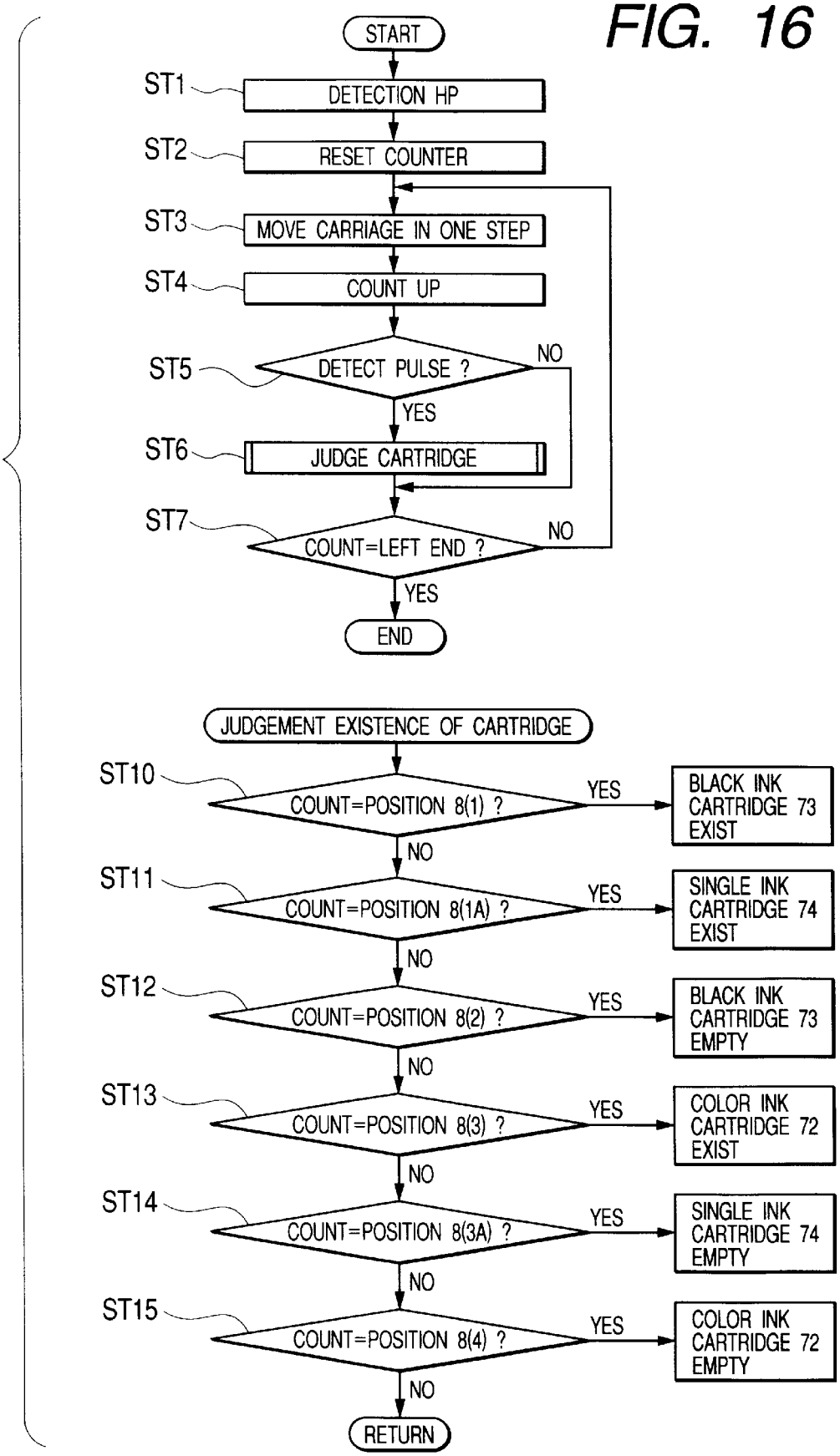
FIG. 16 is a flowchart for judgement of the cartridge.

FIG. 15 depicts a pulse timing chart based on a waveform detected by the optical detector shown in FIG. 14, and FIG. 16 shows a flowchart for judgement of the cartridge.

When starting the printer, the printer initializes such that, for example, the carriage 8 is positioned at a home position. In this case, the carriage motor 2 of the step motor may be driven in the predetermined step driving to bring the carriage 8 into contact with the frame side plate member 21. After that, the carriage motor rotation direction is changed to primary confirm the detecting signal (HP).

After confirming the home position P(HP), the counter is reset (ST2) and the carriage 8 is moved according to one step movements (ST3) where the counter starts to count (ST4) every one step movement of the carriage 8.

The pulse detected by the optical detector 38 is detected along with the movement of the carriage 8 (ST5) When the pulse is detected, the confirmation is performed by a cartridge judgement routine (ST6).

As shown in FIG. 14(*a*), when the ink cartridge 73 exists, the pulse P8(1) is detected, whether or not the counter value of the detected pulse is within that of the predetermined set position to judge the color of ink cartridge. In this case, the first detected pulse P8(1) is judged as a position 8(1) to recognize that the black cartridge 73 is loaded (ST10).

Then, the ink cartridge condition is specified by collating the counter value of the detected pulse with the counter value corresponding to the predetermined region (ST10 to ST15).

On the other hand, when the counter value is recognized to the condition where the carriage 8 is positioned at the left end within the carriage 8 movement region, the routine is finished to return to start.

In order to confirm the home position, the operation that the carriage 8 is brought into contact with the frame side plate member 21 is only performed at the start. After subtracting the counter value corresponding to the carriage movement and several counts from the counter, the first pulse is recognized as the home position after changing the movement direction, again.

While the ink is consumed by printing, in other words, when the pulse P8(2) shown in FIG. 15 is detected to judge that the black ink cartridge 73 is empty (ST12), the error processing is subjected. As described above, this process is operable for determining the type of cartridge and the ink end thereof by judging the pulse detected in every carriage movement.

Next, in the above-described embodiments, the optical detection mechanism of reflection type comprising the optical detector and the detected parts each implemented as a right-angle prism is adopted, but any other type of detection mechanism can also be adopted. For example, a generally used optical detector of a transmission type or a mechanical switch such as a microswitch can also be used. Further, as the structure of each detected part, any other than the right-angle prism can be adopted.

Figure 17:
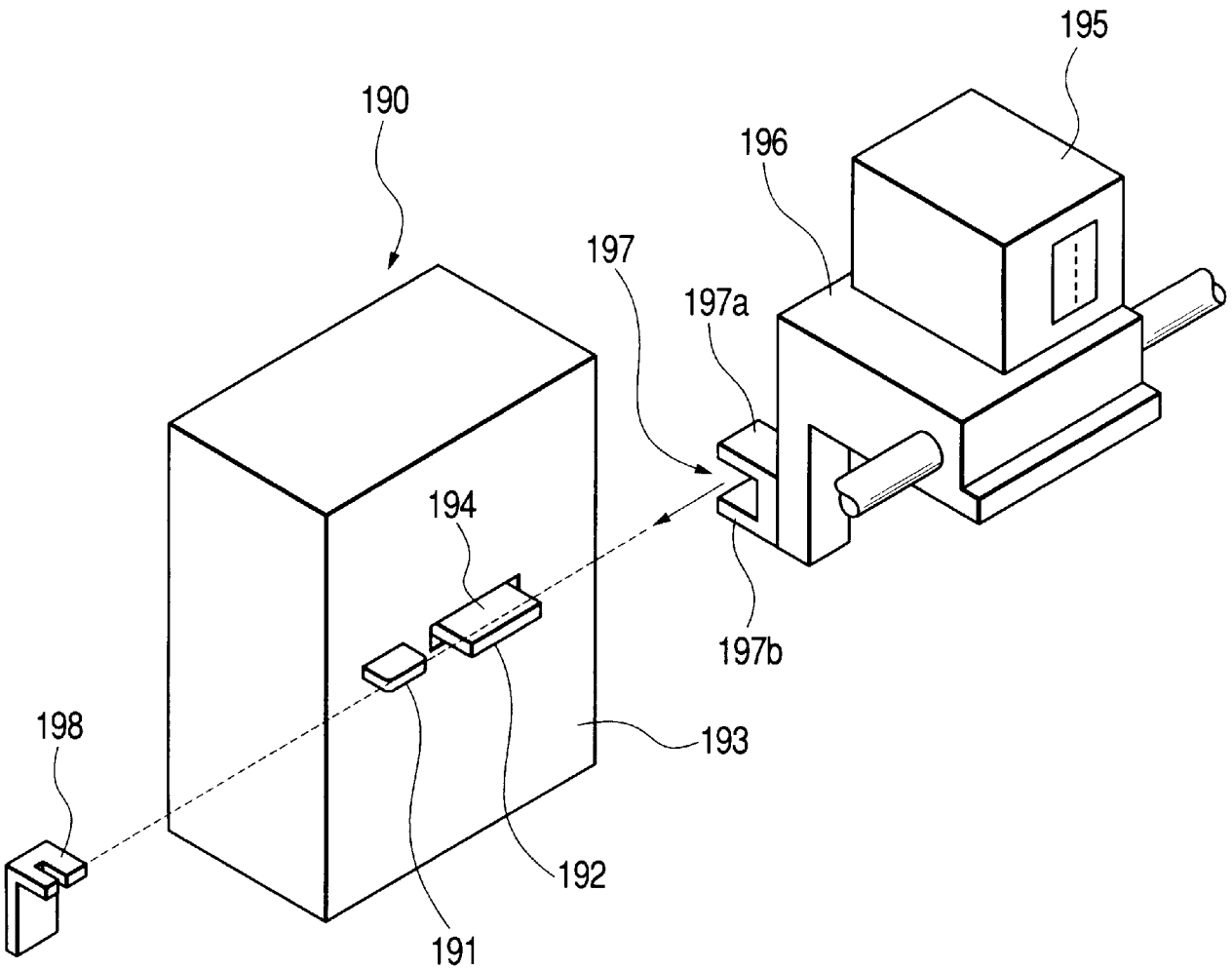
FIG. 17 is a schematic representation to show another detection mechanism for detecting the presence or absence of ink and an ink cartridge being placed.
Figure 18A:
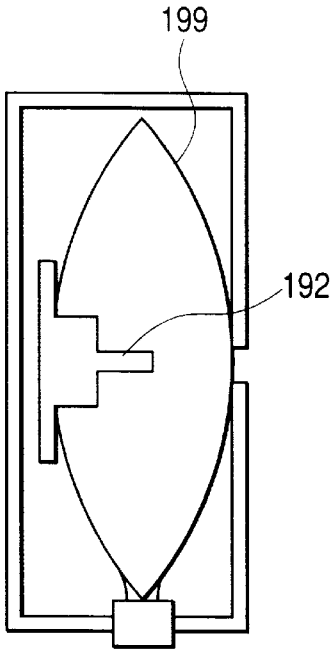
FIGS. 18(A) and (B) are schematic representation to show the operation of a detection piece for indicating the presence or absence of ink in the ink cartridge in FIG. 17.
Figure 18B:
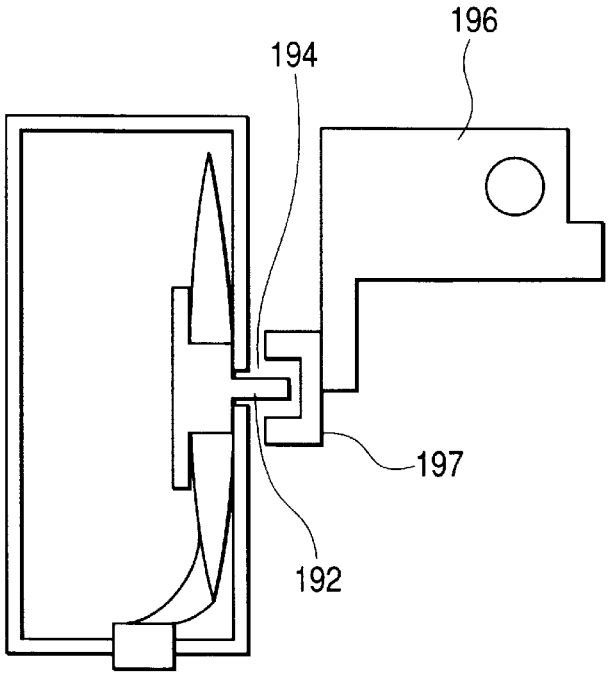

FIGS. 17 and 18 are drawings to describe an example of a detection mechanism having a different configuration than the above-described configuration containing the optical detector and the detected parts. Referring to the figures, detection pieces 191 and 192 as detected parts are projected from one side of an ink cartridge 190. The detection piece 191 is a projection formed integrally with a cartridge case 193 for detecting the ink cartridge 190 being placed. The other detection piece 192 is projected to the outside through a slit 194 made in the cartridge case 193 when the ink cartridge 190 becomes empty of ink.

A transmission type optical detector 197 is attached to the side of a carriage 196 on which an ink jet head 195 is mounted, opposed to the detection pieces 191 and 192 of the ink cartridge 190. As the carriage 196 moves, the detection pieces 191 and 192 are positioned between a light emission element 197*a* and a light reception element 197*b* of the optical detector 197 and thus can be detected. A detection piece 198 having a slit so as to provide a different detection waveform from that of the detection piece 191, 192 is placed at a home position of the carriage 196. As the detection piece 198 is detected, it is determined that the carriage 196 is placed at the home position.

As shown in FIG. 18(*a*), a flexible ink bag 199 storing ink is placed in the ink cartridge 190. As the ink bag 199 becomes empty of ink, the ink bag 199 becomes thin and the detection piece 192 attached to the ink bag 199 moves accordingly. When the ink bag 199 is completely empty of ink, the detection piece 192 is projected to the outside through the slit 194 made in the cartridge case 193 and can be detected by the optical detector 197.

Next, further embodiments of the present invention will be described hereinbelow.

The detection mechanism described above employs the construction such that the detected part is equipped to each ink cartridge for recognizing the presence or absence of the ink cartridge. Of course, the present invention is not limited by this type of the mechanism. It is also applicable for employing the structure such that the detected part is movably equipped to the ink cartridge holder. This mechanism will be described hereinbelow using FIGS. 19 to 23.

Figure 19:
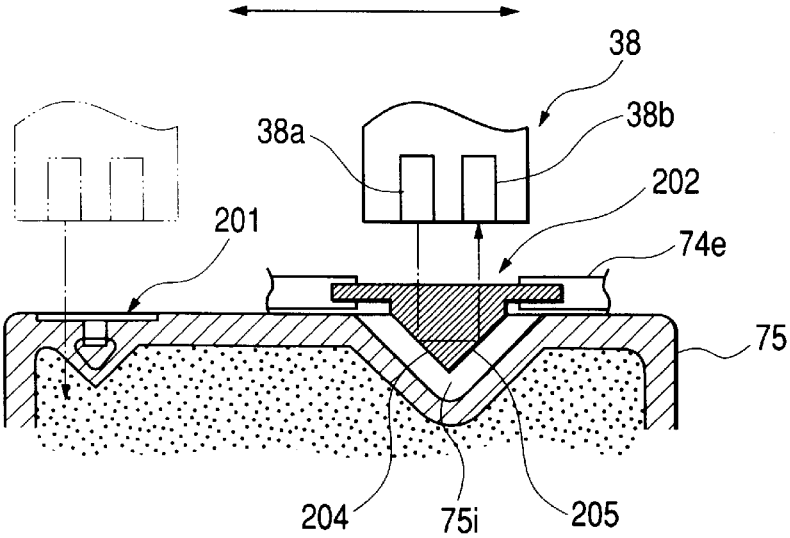
FIG. 19 is a plan view of a detected part on which the ink cartridge is loaded.
Figure 20:
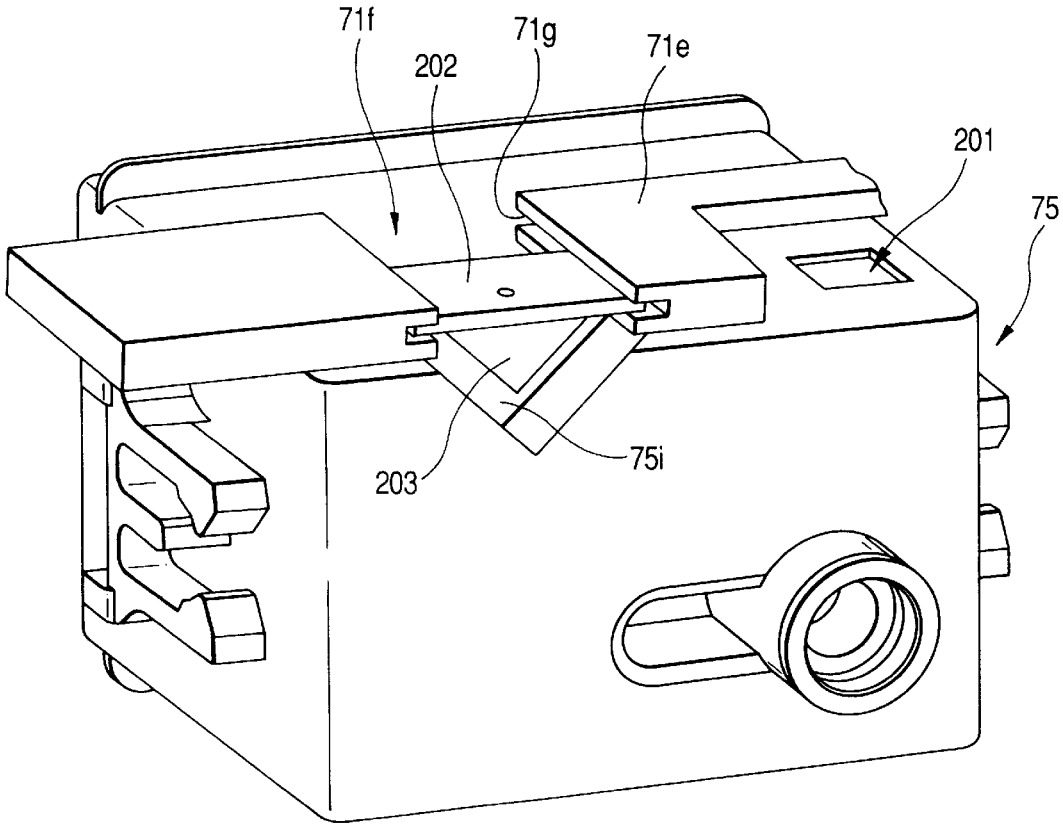
FIG. 20 is a perspective view of the ink cartridge and the a detected part from a back side.
Figure 21A:
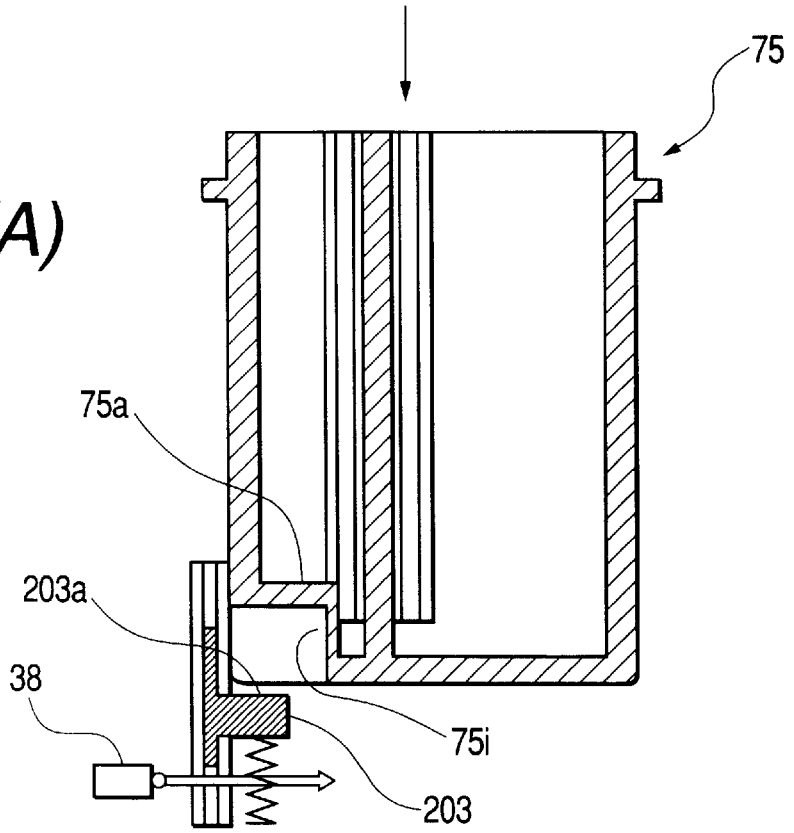
FIGS. 21(A) and (B) are schematic representations to describe the operation of the detected part along with the ink cartridge attached or removed operation in FIG. 19.

FIG. 19 is a plan view of the detected part on which the ink cartridge is loaded, FIG. 20 is a perspective view of the ink cartridge and the detected part from a back side, and FIGS. 21(A) and (B) are schematic representations to describe the operation of the detected part along with the ink cartridge attached or removed operation.

The difference between an ink cartridge 75 and the ink cartridge 72 described in a previous embodiment is that while a detected part 201 of ink cartridge 75 may correspond to the detected part 101 of the previous embodiment, in this embodiment, there is no member equipped as the detected part 102. Rather, the recess portion 75*i* is formed at a position where the detected part 102 is provided.

Further, at a front plate 71*e* of the ink cartridge holder 71, an opening portion 71*f* is formed at a portion facing the recess portion 75*i* of the ink cartridge 75 and a detected member 202 is movably equipped such that the position of the detected member 202 is changed along with the attached or removed operation.

The detected member 202 includes a right-angle prism 203 having two reflection faces 204 and 205 defined to a right-angle therebetween and protrudes toward the inside of the ink cartridge holder 71. The detected member 202 is slidably supported in an up to down direction along with the guide grooves 71*g* formed on the front plate 71*e* at the right and left sides the opening 71*f*, and is pressed upwardly by a compression spring 71*h* (i.e., an urging member).

Figure 21B:
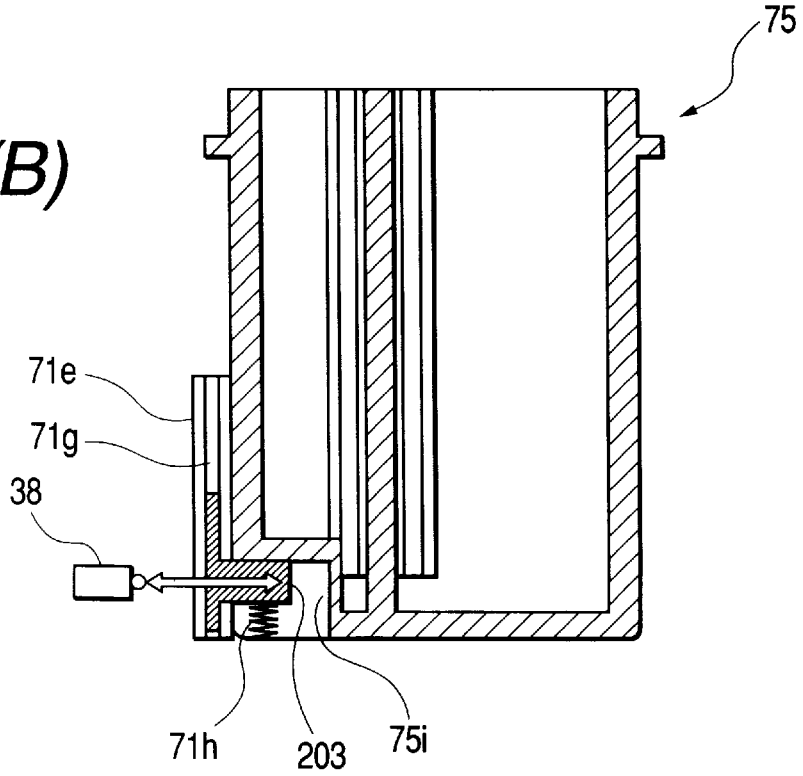

As shown in FIG. 21(A), when the ink cartridge is not attached, the detected member 202 is disposed upwardly from a position facing the optical detector 38, whereas when the ink cartridge 75 is attached on the ink cartridge holder 71, an upper surface 203*a* of the prism 203 is left down until a position facing the optical detector 38 by pressing a contact surface 75*a* of the ink cartridge holder 75 to position the detected member 202 into the recess portion 75*i* formed at the ink cartridge 75, as shown in FIG. 21(B).

As shown in FIG. 19, while attaching the ink cartridge 75, the optical detector 38 moves to a position facing the detected member 202 and emits a light to the detected member 202 so that the irradiated light passes through the inside of the detected member 202 and subsequently reflects by the reflection faces 204 and 205 to be received to a receiving element 38*b* of the optical detector 38 as an incident light.

On the other hand, in the condition that the ink cartridge 75 is not attached, the detected member is disposed upwardly. Thus, if the light is irradiated, the reflection light reflected by the reflection surfaces 203 and 204 is not incident to the receiving element 38*b* of the optical detector 38.

In this configuration, the attached or removed condition of the ink cartridge 75 can be detected by the optical detector 38 without employing a refection portion for detecting an ink cartridge attached or removed condition to the ink cartridge 75.

Next, a further embodiment will be described such that the detected part for detecting whether or not the ink cartridge is attached or removed is rotatably provided with the ink cartridge holder.

Figure 22:
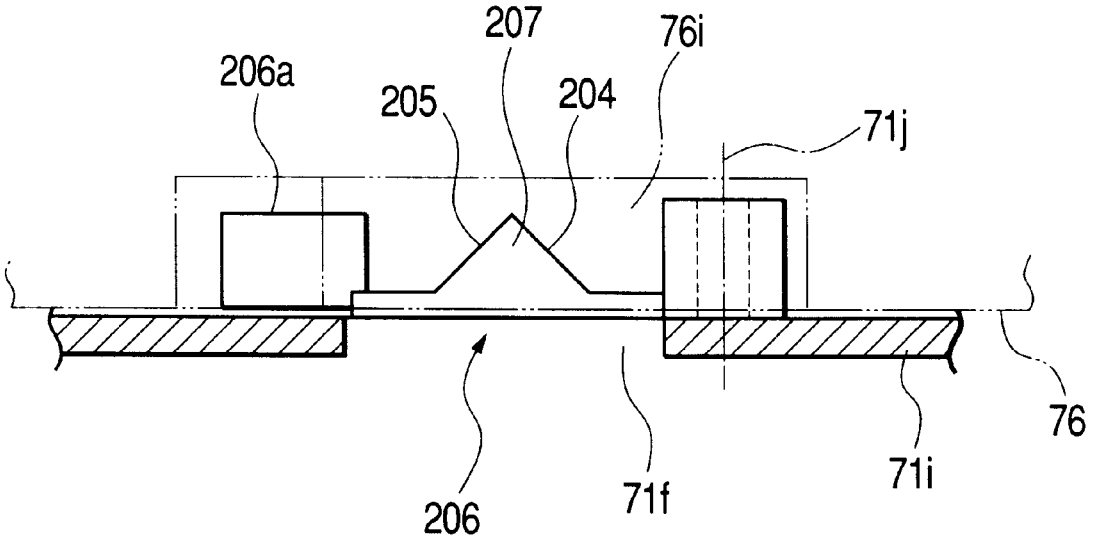
FIG. 22 is a top view of a part adjacent to the detected member.
Figure 23A:
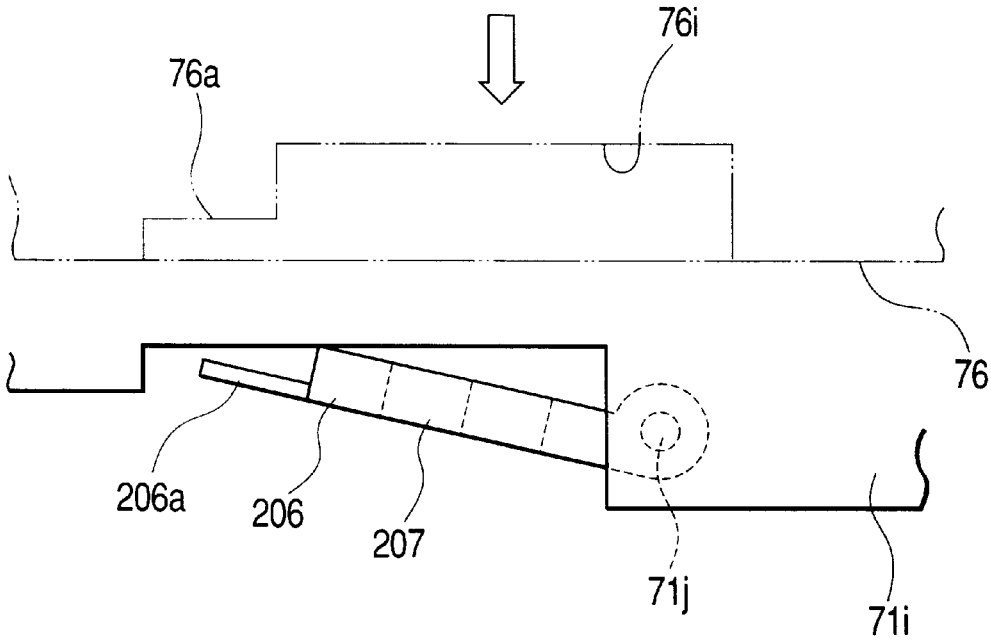
FIGS. 23(A) and (B) are schematic representations to depict the operation of the detected part along with the ink cartridge attached or removed operation in FIG. 22.
Figure 23B:
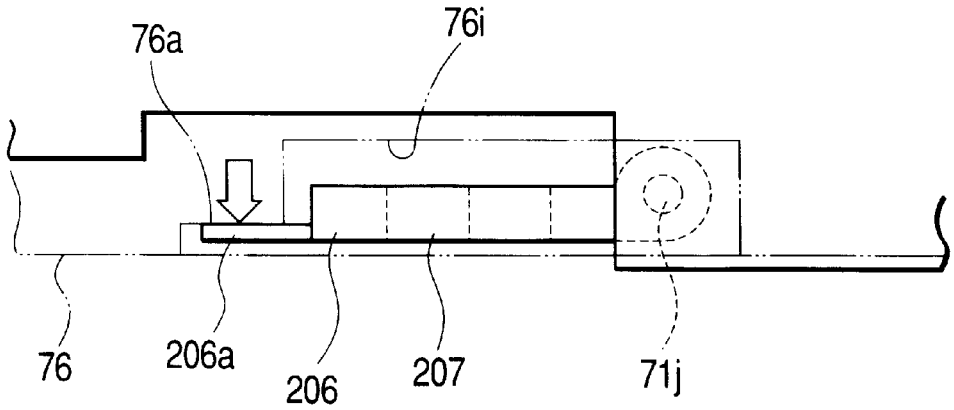

FIG. 22 depicts a top view of a part adjacent to the detected member, and FIGS. 23(A) and (B) are schematic representations to describe the operation of the detected part along with the ink cartridge attached or removed operation.

As shown in these figures, the detected member 206 has the prism 207 including the reflection faces 204 and 205 defined to a right angle therebetween and protruding towards the inside of the cartridge holder 71. The detected member 206 in this embodiment is rotatably supported about an axis 71*i* provided on the end portion of the opening 71*f* of the front plate 71*e* and is urged upwardly by a twisted coil spring (not shown).

As shown in FIG. 23(A), when the ink cartridge 76 is not attached, the prism 207 provided on the detected member 206 is disposed upwardly from a position facing the optical detector 38, whereas when an ink cartridge 76 is attached on the ink cartridge holder 71, an engagement portion 206*a* of the detected member 206 is pressed by a contact surface 76*a* of the ink cartridge 76 to rotate the detected member 206 in a counterclockwise direction.

In this construction, as similar to the previous embodiment, the attached or removed condition of the ink cartridge 76 can be detected by the optical detector 38 without employing a refection portion for detecting an ink cartridge attached or removed condition to the ink cartridge 75.

The description described above is addressed to a single ink cartridge. Of course, when two or more ink cartridges are employed, the detected member corresponding to the each ink cartridge is equipped to enjoy the same effect and advantages.

As described above, the detected part for detecting the ink cartridge presence or absent condition is movably mounted on the cartridge holder side so that it is free from the detected part for detecting the ink cartridge present or absent condition. Thus, the ink cartridge shape is simplified and the manufacturing cost for ink cartridge is reduced.

Further, the detected member may be rotatably and/or slidably supported with respect to the cartridge holder so that the movable detected member is simply constructed to prevent the ink cartridge manufacturing cost from being increased.

In the above-described embodiments, the single detector is mounted on the carriage, but two detectors can also be mounted, for example. In this case, a detection method can be provided wherein at the same position of the carriage, one detector detects the presence or absence of an ink cartridge and the other detector detects the presence or absence of ink or the like.

Further, in the above-described embodiments, the prism comprising the two reflection faces orthogonal to each other is used, but the prism may comprise multiple reflection faces having a plurality of detectable positions. In this case, the number of detectable occasions is increased and thus the detection accuracy can be improved.

Still further, in the above-described embodiments, the ink cartridge is attached to the printer body side. The present invention could be applied to the printer such that the ink cartridge is attached to the carriage. Namely, the detected member is equipped to the cartridge holder mounted on the carriage, and the detected member is detected by the optical detector arranged on the printer body to enjoy the same effect and advantage of the embodiments described above.

As described above, according to the invention, in the off-carriage type serial ink jet printer, the detector is mounted on the carriage and the detected parts that can be detected by the detector are formed on the ink cartridges, etc., making up the ink supply section along the move passage of the carriage. A detected part may also be placed at the position indicating the home position of the carriage or the like.

Therefore, according to the invention, the common detector and the detected parts can detect the information concerning the ink supply section and the information concerning the carriage move position. The invention is extremely advantageous for cost reduction and miniaturization of the printer as compared with the case where a plurality of detection mechanisms must be placed in response to the types of information to be detected as in the related art.

Since the type of ink cartridge placed is also detected, the detrimental effects caused by the user who forgets to operate the switch as with the case where the DIP switch is operated for switching the print mode between single-color print and multicolor print as in the related art can be avoided.

What is claimed is:

1. An ink jet printer comprising:

an ink jet head;

a carriage mounting the ink jet head and moveable in a print width direction;

an ink supply section placed at a fixed position for supplying ink to the ink jet head; and a detector and one or more detected parts that can be detected by the detector, wherein the one or more detected parts are placed at a position along a move passage of the detector, and the one or more detected parts are operable to indicate at least one of information concerning the ink supply section and information concerning a move position of the carriage.

2. The ink jet printer as claimed in claim 1, wherein the information concerning the ink supply section includes at least one of information indicating whether or not ink exists in the ink supply section and information representing a type of ink stored in the ink supply section.

3. The ink jet printer as claimed in claim 1, wherein the information concerning the move position of the carriage includes information indicating whether or not the carriage is at a home position.

4. The ink jet printer as claimed in claim 1, wherein the one or more detected parts are a first detected part that can indicate the information concerning the ink supply section, and a second detected part that can indicate the information concerning the move position of the carriage.

5. The ink jet printer as claimed in claim 4, wherein the information concerning the ink supply section includes at least one of information indicating whether or not ink exists in the ink supply section and information representing a type of ink stored in the ink supply section.

6. The ink jet printer as claimed in claim 4, wherein the information concerning the move position of the carriage includes information indicating whether or not the carriage is at a home position.

7. The ink jet printer as claimed in claim 1, wherein the detector is an optical detector comprising a light emission element and a light reception element and each of the one or more detected parts includes a prism having one or more reflection faces for reflecting light from the light emission element toward the light reception element.

8. The ink jet printer as claimed in claim 7, wherein the one or more detected parts are operable to indicate the information concerning the ink supply section and the prism of each of the one or more detected parts is formed in a side wall portion of an ink reservoir of the ink supply section.

9. The ink jet printer as claimed in claim 8, wherein at least one of the one or more detected parts further includes a gap formed between the one or more reflection faces of its corresponding prism and a side plate portion opposed thereto at an opposite position to a light incidence direction from the detector on the corresponding prism.

10. The ink jet printer as claimed in claim 1, wherein the ink supply section includes an ink cartridge placement section and an ink cartridge detachably placed therein.

11. The ink jet printer as claimed in claim 10, wherein the information concerning the ink supply section includes at least one of information indicating whether or not the ink cartridge is placed in the ink cartridge placement section, information concerning a type of placed ink cartridge, and information indicating whether or not ink exists in the placed ink cartridge.

12. The ink jet printer as claimed in claim 10, wherein the detector is an optical detector comprising a light emission element and a light reception element and each of the one or more detected parts includes a prism having one or more reflection faces for reflecting light from the light emission element toward the light reception element.

13. The ink jet printer as claimed in claim 12, wherein the one or more detected parts are operable to indicate the information concerning the ink supply section and the prism of each of the one or more detected parts is formed in a side wall portion of an ink reservoir of the ink cartridge.

14. The ink jet printer as claimed in claim 13, wherein at least one of the one or more detected parts further includes a gap formed between the one or more reflection faces of its corresponding prism and a side plate portion opposed thereto at an opposite position to a light incidence direction from the detector on the corresponding prism.

15. The ink jet printer as claimed in claim 13, wherein the one or more detected parts are first and second detected parts that are placed at different positions along the move passage of the detector in the side wall portion of the ink cartridge placed in the ink cartridge placement section.

16. The ink jet printer as claimed in claim 15, wherein the second detected part further includes a gap formed between the one or more reflection faces of its corresponding prism and a side plate portion opposed thereto at an opposite position to the light incidence direction from the detector on the corresponding prism.

17. The ink jet printer as claimed in claim 16, wherein the first detected part is provided for detecting the presence or absence of ink in the ink cartridge and the second detected part is provided for detecting the ink cartridge being placed in the ink cartridge placement section.

18. The ink jet printer as claimed in claim 17, wherein at least one of the first and second detected parts is provided for further detecting a type of ink cartridge.

19. The ink jet printer as claimed in claim 17, wherein a formation position of the second detected part is a different position along the move passage of the detector in response to a type of ink cartridge.

20. The ink jet printer as claimed in claim 19, wherein the ink cartridge includes first and second ink cartridges placed in the ink cartridge placement section for use, wherein each of the first and second ink cartridges is formed with the first and second detected parts.

21. The ink jet printer as claimed in claim 20, wherein the ink cartridge further includes a third ink cartridge placed in the ink cartridge placement section for use, wherein the third ink cartridge is also formed with the first and second detected parts, and wherein in a placement state in the ink cartridge placement section, the positions of the second detected parts of the first and second ink cartridges differ from the position of the second detected part of the third ink cartridge.

22. The ink jet printer as claimed in claim 21, further comprising determination means for determining whether a print mode is single-color print or multicolor print based on the detection result of at least one of the three second detected parts.

23. The ink jet printer as claimed in claim 1, wherein the detector mounted on the carriage includes a plurality of detectors.

24. An ink jet printer comprising:

an ink jet head;

a carriage mounting the ink jet head and moveable in a print width direction;

an ink cartridge accommodating an ink supplied to the ink jet head and attached to an ink cartridge holder;

an optical detector including a light emission element and a light reception element, and mounted to one of the carriage and a mounting member fixed on a predetermined position;

a detected member that can be detected by the optical detector, the detected member operable to change its position in accordance with an attached or removed condition of the ink cartridge with respect to the ink cartridge holder.

25. The ink jet printer as claimed in claim 24, wherein the detected member is one of slidably and rotatably mounted with respect to the ink cartridge holder.

26. The ink jet printer as claimed in claim 25, wherein the detected member is urged to a first position by an urging member, and moves to a second position when contacted by the ink cartridge.

* * * * *